US007263751B2

(12) United States Patent
Davis et al.

(10) Patent No.: US 7,263,751 B2
(45) Date of Patent: Sep. 4, 2007

(54) LIGHTWEIGHT VIEWING CASKET

(75) Inventors: Gerald H. Davis, Fountain City, IN (US); Gary L. Cox, Richmond, IN (US); Chad L. Eversole, Richmond, IN (US)

(73) Assignee: Vandor Corporation, Richmond, IN (US)

( * ) Notice: Subject to any disclaimer, the term of this patent is extended or adjusted under 35 U.S.C. 154(b) by 237 days.

(21) Appl. No.: 10/897,970

(22) Filed: Jul. 23, 2004

(65) Prior Publication Data

US 2005/0055813 A1 Mar. 17, 2005

Related U.S. Application Data

(60) Provisional application No. 60/489,552, filed on Jul. 23, 2003, provisional application No. 60/489,554, filed on Jul. 23, 2003.

(51) Int. Cl.
*A61G 17/00* (2006.01)

(52) U.S. Cl. ..... 27/4; 27/14; 27/27; 16/424; 229/117.09

(58) Field of Classification Search ..... 27/2, 27/4, 17, 14, 27; 16/424, 425; 217/65; 220/6; 229/117.09, 939; 99/7, 12
See application file for complete search history.

(56) References Cited

U.S. PATENT DOCUMENTS 52,405 A * 2/1866 Fogg ..... 27/2
54,321 A * 5/1866 Fogg ..... 27/2
559,457 A * 5/1896 Lautner ..... 27/4
663,641 A * 12/1900 Ruebkam ..... 27/4
703,934 A * 7/1902 Koeser ..... 27/4
1,238,219 A * 8/1917 Thompson ..... 27/4
2,192,686 A 3/1940 Hummel
3,133,334 A 5/1964 Johnsen
3,208,188 A 9/1965 Fulton et al.
3,220,080 A * 11/1965 Connelly ..... 27/2
3,270,943 A 9/1966 Polenghi
3,512,696 A 5/1970 Ebert
3,574,906 A 4/1971 Rittenhouse
3,613,189 A 10/1971 Kirby
3,654,676 A 4/1972 McHugh
3,729,786 A * 5/1973 Walding ..... 27/3
3,810,282 A 5/1974 Doggett
3,868,799 A 3/1975 Hayward
4,063,337 A 12/1977 Havey, III
4,120,444 A 10/1978 Gray
4,139,929 A 2/1979 Angermann
4,154,031 A 5/1979 Williamson, Jr.

(Continued)

*Primary Examiner*—William L. Miller
(74) *Attorney, Agent, or Firm*—Maginot Moore & Beck

(57) ABSTRACT

A casket assembly includes a container and a two-piece lid. The two-piece lid includes a superior lid that covers the anterior end of the casket and an inferior lid that covers the opposite end. The container includes a bottom panel, an inferior end panel, a superior end panel, and two elongated side panels. Each elongated side portion has a recessed portion on the superior end of the casket for providing an improved viewing of the deceased. In one embodiment, the casket panels each include a plurality of mortise holes and/or tenons. The tenons on individual panels are designed to fit into the mortise holes on other panels. Pins are placed through pinholes on the tenons to retain the tenons in the mortise holes. A shelf and bracket assembly may be provided for use in displaying mementos of the deceased and/or for supporting the inferior casket lid.

17 Claims, 31 Drawing Sheets

U.S. PATENT DOCUMENTS 4,156,956 A 6/1979 Partridge et al.
4,170,054 A 10/1979 Ruffner et al.
4,173,287 A * 11/1979 Kumakawa ..... 217/65
4,177,543 A 12/1979 Angermann
4,215,627 A 8/1980 Garriss
4,249,289 A 2/1981 Work
4,266,670 A * 5/1981 Mykleby ..... 206/600
4,288,952 A 9/1981 Work
4,315,353 A 2/1982 Sorensen
4,337,556 A 7/1982 Winburn et al.
4,399,596 A * 8/1983 Parlour et al. ..... 27/4
4,524,902 A 6/1985 Mortimer
4,730,370 A 3/1988 Elder
4,773,134 A 9/1988 Kay
4,788,757 A 12/1988 Bethune et al.
4,869,424 A 9/1989 Wood
4,944,076 A 7/1990 Kay et al.
4,967,455 A 11/1990 Elder
5,140,728 A 8/1992 Chandler et al.
5,307,545 A 5/1994 Stoltz
5,353,484 A 10/1994 Woedl et al.
5,481,785 A 1/1996 Minton et al.
5,555,612 A * 9/1996 Biondo ..... 27/2
5,586,679 A 12/1996 Thomas
5,623,752 A 4/1997 Gillard et al.
5,659,932 A 8/1997 Wright
5,815,898 A 10/1998 Jenkins
5,915,680 A 6/1999 Umemura et al.
5,956,825 A 9/1999 McCoy et al.
5,960,978 A 10/1999 Jenkins
6,015,084 A 1/2000 Mathieu et al.
6,145,175 A 11/2000 Enneking et al.
6,154,937 A 12/2000 Enneking et al.
6,269,526 B1 8/2001 Bischoff et al.
6,317,943 B1 11/2001 Wood
6,330,968 B1 12/2001 Peleman
6,385,824 B1 5/2002 Schwartz
6,497,018 B1 * 12/2002 Chiu et al. ..... 27/2
6,625,852 B1 9/2003 Hanson
6,629,321 B1 10/2003 Hunt et al.
6,684,467 B1 2/2004 Walker
2001/0049868 A1 12/2001 Tambussi
2002/0023325 A1 2/2002 Fant et al.
2002/0053120 A1 5/2002 Cox et al.
2002/0166217 A1 11/2002 Lew
2004/0031133 A1 2/2004 Pace et al.
2004/0036192 A1 2/2004 Yang

* cited by examiner

LIGHTWEIGHT VIEWING CASKET

CROSS-REFERENCE TO RELATED APPLICATIONS

This application claims the benefit of U.S. provisional application No. 60/489,552, filed Jul. 23, 2003, and U.S. provisional application No. 60/489,554, also filed Jul. 23, 2003.

Cross-reference is also made to the following U.S. patent applications, each having a filing date of Jul. 23, 2004, and filed under the following titles and Express Mail labels: LIGHTWEIGHT VIEWING CASKET WITH HANDLES, Ser. No. 10/897,972; MORTISE AND TENON CASKET, Ser. No. 10/898,151; MORTISE AND TENON CASKET WITH PINS, Ser. No. 10/898,689; MORTISE AND TENON CASKET WITH SHELF AND BRACKET ASSEMBLY, Ser. No. 10/898,005; BURIAL BELL AND TRAY, Ser. No. 10/897,579; RENTAL CASKET WITH REMOVABLE END PANEL, Ser. No. 10/897,565; and MULTIPURPOSE FUNEREAL TRAY, Ser. No. 10/898,004.

FIELD OF THE INVENTION

The field of the invention relates generally to caskets.

BACKGROUND

Cremation containers are containers in which a deceased may be placed prior to cremation. Cremation containers range from elaborate hardwood caskets to simple corrugated paper cartons. Some cremation containers are intended to be consumed during cremation, and others are not.

Cremation is often considered to be a low cost funerary option, as it eliminates the need for interment space. Extremely low costs may be achieved by employing a corrugated paper cremation container, which is a fraction of the cost of hardwood or metal caskets. Even if cost is not a major consideration, corrugated paper caskets are a popular choice for cremation.

Many corrugated paper caskets have design elements that approximate decorative wood or steel caskets. Such paper caskets are suitable for presentation at a viewing and/or funerary service. These ornately designed paper caskets represent a cost savings over hardwood caskets, and are particularly advantageous in cases in which the casket is to be consumed during the cremation process.

While ornately designed paper caskets are less expensive than hardwood caskets, they still represent a significant cost that may not be practical in some cases. In such cases, the least expensive option is a simple rectangular corrugated paper container and associated simple rectangular lid that fits over the container in a manner similar to that of a common shoe box. The deceased fits within the container and then the rectangular lid is fitted over the container to close off the casket.

One drawback associated with the simple rectangular paper container is the perceived lack of dignity that the container provides. While the simple rectangular paper container may not be intended for elaborate funerary proceedings, there is still a need for identification of a deceased by the next-of-kin, and often a need for the closest relatives to pay last respects. Such viewings are often emotional in nature, and the container should provide the appearance of some dignity, even if expensive containers are not an option.

There is a need therefore, for a casket or cremation container that retains much or all of the economy of the simple rectangular container design while providing additional aesthetic display of the deceased for identification and viewing purposes.

Another problem with prior art corrugated box container caskets relates to handles for carrying the container. Typically, a handle is formed as a cut-out in the corrugated container. However, a drawback associated with this type of handle is that one lifting the casket could contact the remains located within the casket. Therefore, there is also a need for a handle that may be used with corrugated container and other relatively inexpensive caskets that allows the casket to be easily and comfortably lifted while shielding the casket bearer from the remains of the deceased.

Yet another problem with relatively inexpensive caskets and cremation containers lies in the manufacturing method for such containers. In particular, such containers must be constructed of materials that are sufficiently strong to bear the weight of the deceased. To this end, the method of joining the different panels of the container must not only be inexpensive, but must be reliable, such that the joints of the container can dependably bear the weight of the deceased in the casket. At the same time, the material used to connect the joints should be as aesthetically pleasing as possible.

Although the paperboard caskets mentioned above are one extremely inexpensive option for cremation containers, it is often helpful to provide a number of relatively inexpensive casket options to the family of the deceased. These casket options typically cover several price ranges and include various features. Such caskets may be made of a number of different materials, including wood, metal, and paper materials, as well as combinations of the foregoing. Traditional wood-based caskets are preferred by many and continue to experience widespread use because they combine a high level of strength with desirable aesthetic qualities. Typical wood caskets, however, can be extremely expensive. Even caskets that use less expensive types of wood and simpler designs have considerable expense.

The main cost elements in a wood casket, as with virtually any manufactured product, includes the raw materials and the labor associated with assembly. Less expensive caskets have been made of low grade steel, but such caskets do not represent a significant cost savings over the low-end wood caskets. As mentioned above, paperboard caskets have been used for cremation containers, but paperboard caskets do not convey the quality and warmth of wood.

Thus, there is a need for a casket having reduced cost as compared to traditional casket manufactures, particularly for a casket that conveys the natural beauty and warmth of wood.

SUMMARY

The inventions described herein have several aspects, each of which individually addresses one or more of the problems of the prior art discussed above, and/or other problems or shortcomings not specifically mentioned, but which will become readily apparent to those of ordinary skill in the art by reference to the following detailed description and accompanying drawings.

A first embodiment of the invention is a casket having a container, a first lid and a second lid. The container has a bottom and four sides that are integrally formed. The first lid has a top and a plurality of sides that are integrally formed of corrugated paper. The first lid covers a first portion of the container, and at least a first side of the first lid is disposed intermediate two ends of the container. The second lid has a top and a plurality of sides that are also integrally formed of corrugated paper. The second lid covers a second portion of the container and has a second side that is disposed intermediate the two ends of the container. Each of the first side and the second side includes a concavity.

The concavity in the intermediate sides allows for the use of two lids in an inexpensive low profile cremation container or casket. The low profile aspect reduces cost and further facilitates identification and/or viewing of the deceased. The use of two lids allows for identification and/or viewing of only the upper torso. A casket that permits selective viewing of only the upper torso provides increased sensitivity and care.

Another embodiment of the invention is a casket that includes a container and an insertable handle. The container is formed of corrugated paper and has an interior configured to receive the remains of a deceased. The container also includes a plurality of handle openings. The insertable handle is inserted into one of the handle openings and has a finger receiving receptacle. The insertable handle further includes a protective barrier between the interior of the container and the finger receiving receptacle.

Still another embodiment of the invention fulfills one or more of the above needs, as well as others, by providing a casket formed with a plurality of panels having a mortise and tenon interlocking parts. The mortise and tenon assembly allows for ease of manufacture, and provides a unique, aesthetically attractive wood-based alternative to traditional caskets. To this end, one aspect of the invention is a casket that includes a plurality of panels assembled into a container. Each panel has two sides and a number of edges. At least a first panel includes a plurality of tabs extending from at least a first edge thereof. At least a second panel includes a plurality of holes, and wherein the plurality of tabs extending through the plurality of holes.

Another embodiment of the invention includes a mortise and tenon assembly having a plurality of handles arranged and disposed on the exterior of the casket for use by pallbearers. The handle structures include tabs that fit into holes in the side panels of the casket. Pin holes are includes on the handle structures, and pins are inserted into the handle structures to secure the handles to the side panels of the casket. The handle structures thus provide secure and reliable handles on a mortise and tenon casket, while also providing attractive but relatively inexpensive handles.

Yet another embodiment of the invention provides a roller tray that allows reuse of a casket. The deceased may be rolled out from the casket and then cremated. The casket may then be easily re-used. Such a re-usable casket allows for the use of an aesthetically pleasing casket at a fraction of the purchase price. To this end, another aspect of the invention is an arrangement for a casket that includes a bottom panel of a casket. The bottom panel has a plurality of recesses and a plurality of rollers disposed within the recesses, the plurality of rollers disposed in an interior of the casket. Such rollers may be used to facilitate movement of a tray that is disposed within the casket.

Still another embodiment of the invention enhances incineration of a wood (or composite) type casket. This aspect is provided in an embodiment of a cremation container having a bottom panel and a plurality of rails disposed below the bottom panel. At least one of the plurality of rails is disposed between a lower edge of each of a first and second elongate side panel of the cremation container. The rails are particularly useful when the lower edge of each of the first and second elongate side panel is disposed below the bottom panel. In either event, the rails operate to elevate the lower edges of the side panels, which provides for better incineration.

Another embodiment of the invention is a retention pin that includes a head, a shaft and a cosmetic shroud. The shaft includes a retention barb, and the cosmetic shroud extends outward and downward from the head. The shroud may be used to cover unattractive features and/or hardware of a low-budget casket construction.

Yet another embodiment of the invention includes a bracket assembly that may be used to provide a display shelf for an inexpensive casket. The bracket assembly may be mounted on the side panel of the casket and provides a shelf for displaying mementos, flowers or other sentimental displays. The bracket assembly may also be used to hold the casket lid, thereby providing a traditional hinged appearance to the casket even though the lid of the casket is not hinged.

The above described features and advantages, as well as others, will become more readily apparent to those of ordinary skill in the art by reference to the following detailed description and accompanying drawings.

DESCRIPTION

Figure 1:
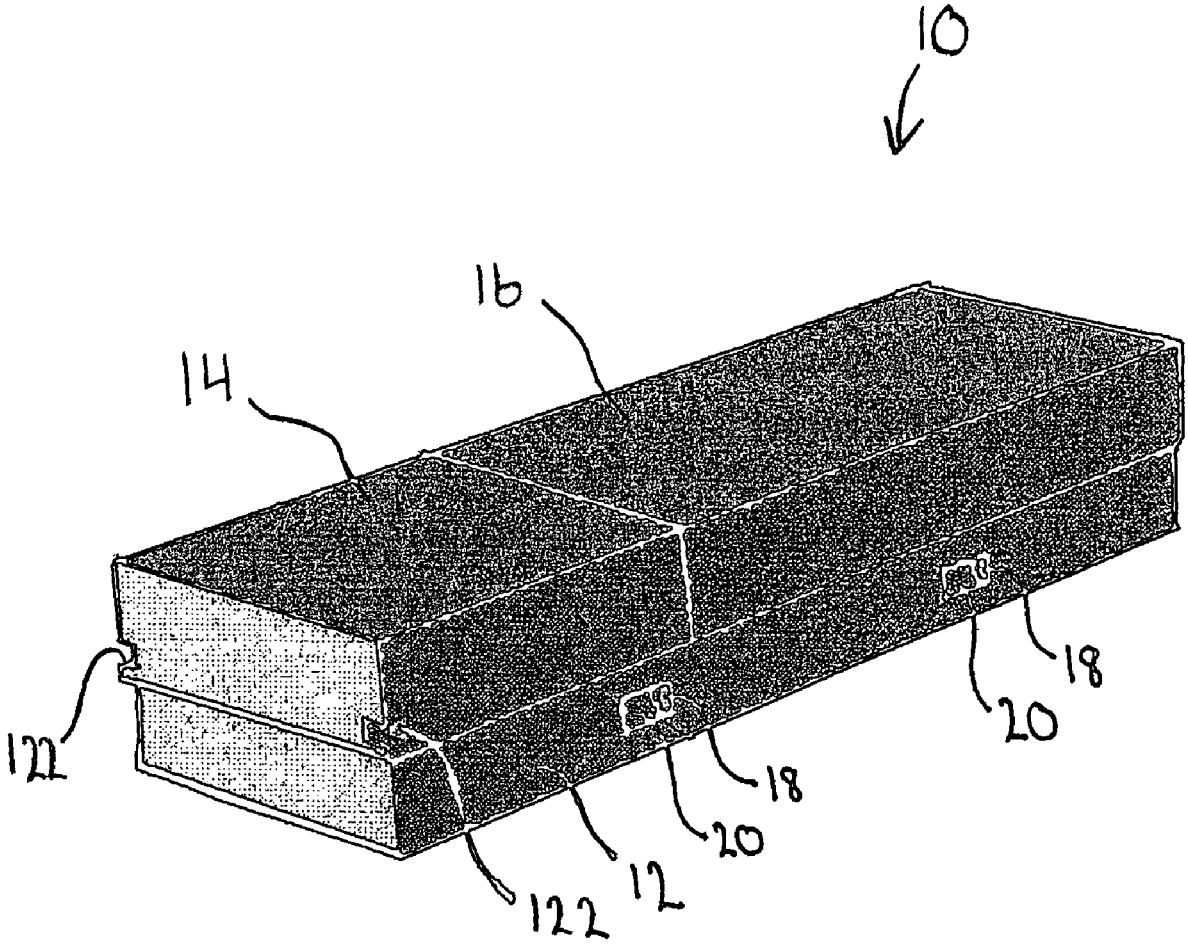
FIG. 1 shows a perspective view of a casket that incorporates several inventive aspects described herein.

FIG. 1 shows a perspective view of an exemplary casket assembly 10 that incorporates aspects of the invention. The casket assembly 10 includes a container 12, a superior lid 14, inferior lid 16 and a plurality of insertable handles 20. The insertable handles 20 are inserted into handle openings 18 formed in the container 12. The container 12, the superior lid 14 and the inferior lid 16 are preferably formed of corrugated paper. Each insertable handle 20 is preferably formed of plastic.

In general, the container 12 is substantially a folded piece of corrugated paper. The corrugated paper is folded to form an open-top box adapted to receive the body of a deceased. The superior lid 14 and inferior lid 16 cooperate to substantially cover the container 12, the superior lid 14 covering a portion of the container 12 in which the head and upper torso of the deceased resides, and the inferior lid 16 covering a portion of the container 12 in which the lower torso and legs of the deceased resides.

Figure 2:
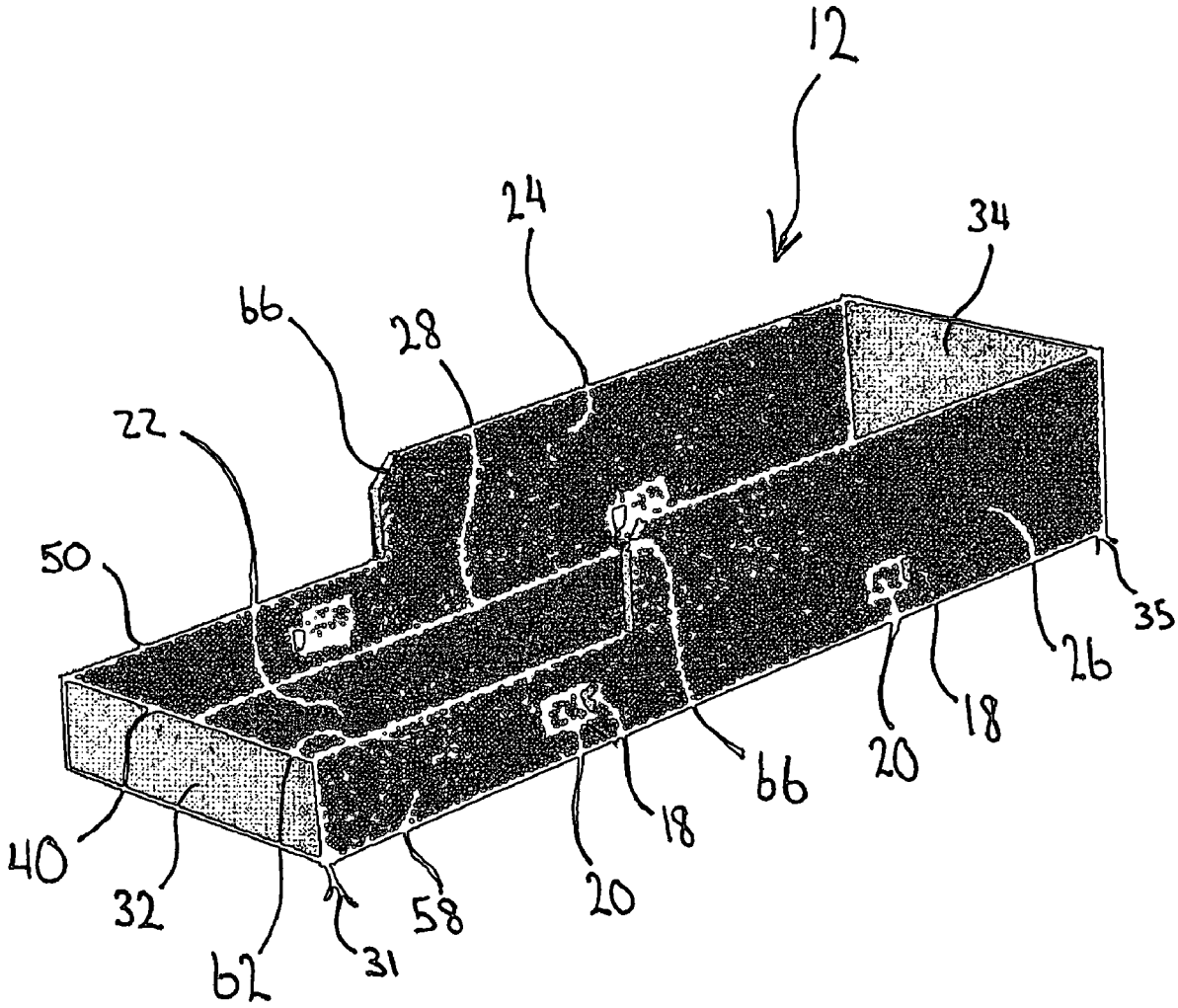
FIG. 2 shows a perspective view of the assembled container portion of the casket of FIG. 1 with the lids removed.
Figure 3:
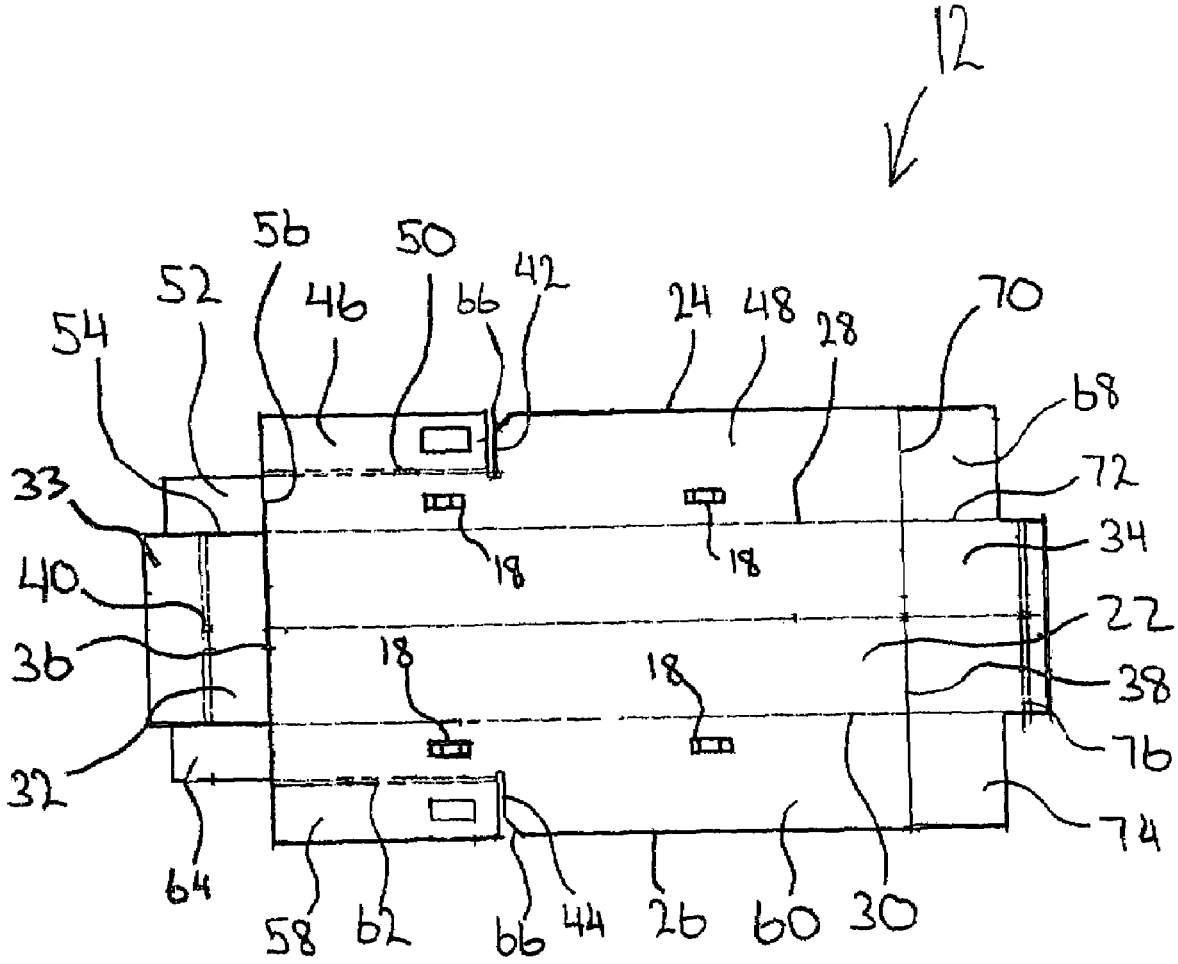
FIG. 3 shows a top plan view of the container portion of FIG. 2, prior to assembly.
Figure 4A:
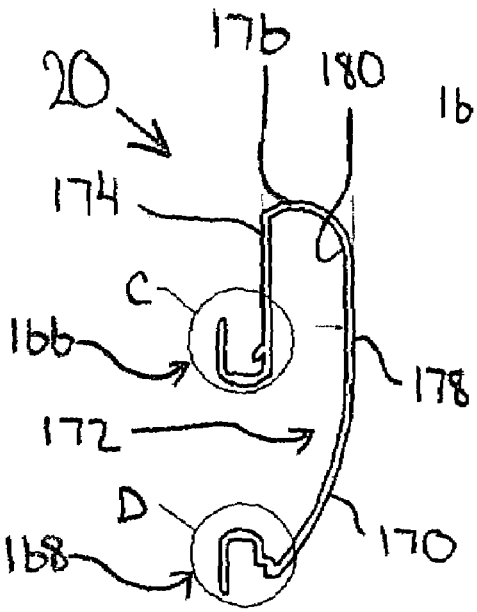
FIG. 4A shows a side elevational view of an exemplary insertable handle according to aspects of the invention.
Figure 4B:
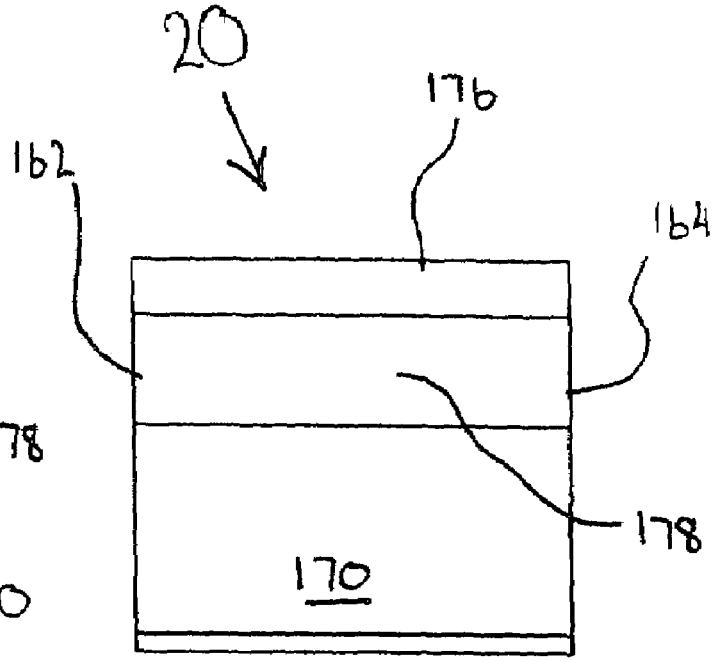
FIG. 4B shows a rear elevational view of the handle of FIG. 4A.
Figure 4C:
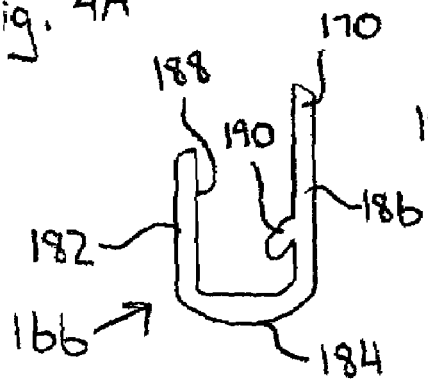
FIG. 4C shows an enlarged view of portion C of FIG. 4A.
Figure 4D:
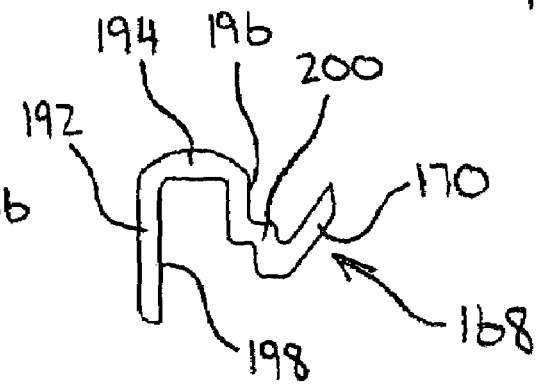
FIG. 4D shows an enlarged view of portion D of FIG. 4A.

FIGS. 2 and 3 show the container 12 apart from the casket assembly 10, or in other words, with the superior lid 14 and inferior lid 16 removed. FIG. 2 shows the assembled container 12 in perspective view, while FIG. 3 shows the unassembled but otherwise cut, scored and creased version of the container 12.

With general reference to both FIGS. 2 and 3, the container 12 includes a bottom panel 22, a first elongate side panel 24, a second elongate side panel 26, a superior end panel 32 and an inferior end panel 34. The first elongate side panel 24, second elongate side panel 26, superior end panel 32 and inferior end panel 34 are formed by folding portions of the container 12 up from the bottom panel 22. To form the first elongate side panel 24, the first elongate side panel 24 is folded up from the bottom panel 22 along first elongate fold line 28. To form the second elongate side panel 26, the second elongate side panel 26 is folded up from the bottom panel 22 along second elongate fold line 30. To form the superior end panel 32, the superior end panel 32 is folded up from the bottom panel 22 along superior end fold line 36. To form the inferior end panel 34, the inferior end panel 34 is folded up from the bottom panel 22 along inferior end fold line 38. The first elongate side panel 24, second elongate side panel 26, superior end panel 32, and inferior end panel 34 are preferably folded up to form a set of planar surfaces that are each perpendicular to the bottom panel 22.

As shown in FIG. 2, the superior end portion 31 of the container 12 has a reduced height. In particular, when the container is assembled, the elongated side panels 24 and 26 both have a first height at a superior end portion 31 and a second height at an inferior end portion 35, with the first height being less than the second height. The reduced height on the superior end portion of the casket provides a low profile on the superior end in the form of a recessed portion and/or concavity. This recessed portion and/or concavity provides an improved viewing environment of the deceased. In particular, the reduced height removes much of the casket material from interfering with the view of the deceased.

To provide the reduced height at the superior end of the container 12, the first elongate side panel 24 includes an inferior side panel portion 48 and a reduced height superior side panel portion 46. Similarly, the second elongate side panel 26 includes an inferior side panel portion 60 and a reduced height superior side panel portion 58. Referring specifically to the superior side panel portion 46, the reduced height is formed by folding over a portion of the superior side panel portion 46 upon itself along a double over fold line 50. In the preferred embodiment, the double over fold line 50 approximately bisects the superior side panel portion 46 such that the reduced height of the superior side panel portion 46 is approximately one-half of the height of the inferior side panel portion 48. The superior side panel portion 58 of the second elongate side panel 26 is formed in a similar manner, by folding over the superior side panel portion 58 at a double over fold line 62.

A first side notch 42 is provided in the first elongate side panel 24 to permit the superior side panel portion 46 to be folded independent of the inferior side panel portion 48. Similarly, the second elongate side panel 26 includes a second side notch 44 to permit the superior side panel portion 58 to be folded independent of the inferior side panel portion 60. Each of the first side notch 42 and second side notch 44 extends at least to the fold lines 50 and 62, respectively. Preferably, each of the first side notch 42 and second side notch 44 extends lengthwise from the edge of the respective panels 24 and 26 slightly past the fold lines 50 and 62, and has a width of between one-quarter inch and two inches to form a notch for receiving the edge of the superior lid 14. Because the first side notch 42 and second side notch 44 extend slightly below the fold lines 50 and 62, they help retain the superior lid 14 on the container 12, as one edge of the superior lid 14 is designed to fit into the first side notch 42 and second side notch 44.

The superior side panel portion 46 further includes a tab 52 extending in a superior direction past the superior end of the bottom panel 22. The tab 52 is formed by a score 54 between the superior end panel 32 and the superior side panel portion 46, and is further defined by a fold line 56. The fold line 56 constitutes an extension of the superior end fold line 36. The score 54 allows the tab 52 to be folded perpendicularly about the fold line 56. The tab 52 has a height that extends to approximately the double over fold line 50. A similar tab 64 is located on the opposite side of the container on superior side panel portion 58.

The superior end panel 32 also has reduced height, and thus is folded over on itself similar to the superior side panel portion 46 and superior side panel portion 58. To this end, the superior end panel 32 includes a double over fold line 40. The superior end panel 32 folds 180° over itself about the double over fold line 40 with the tab 52 from the superior side panel portion 46 and the corresponding tab 64 from the superior side panel portion 58 trapped under the folded under portion 33 of the superior end panel 32. Glue or adhesive may be used to secure the tabs (including tabs 52 and 64) to the superior end panel 32. Alternatively, fasteners or cabling may be placed through the folded over superior end panel 32, the tab 52 and as well as the folded over superior end panel 32 and the other tab from the superior side panel portion 58.

The inferior side panel portion 48 also includes a tab 68 extending from the inferior side panel portion 48 in the inferior direction past the inferior end of the bottom panel 22. The tab 68 is formed by a score 72 between the panel that forms the inferior end panel 34 and the extending portion of the inferior side panel portion 48. The tab 68 is further defined by a fold line 70 that constitutes an extension of the inferior end fold line 38. The score 72 allows the tab 68 to be folded 90° about fold line 70 with respect to the remaining portion of the inferior side panel portion 48. The inferior side panel portion 60 on the opposite side includes a similar tab 74 formed in the same way.

The inferior side panel portion 48 further includes a chamfered edge 66 located on the edge adjoining the first side notch 42. The inferior side panel portion 60 similarly includes a chamfered edge 66 located on the edge adjoining the second side notch 44. The chamfered edges 66 facilitate rotating placement of the inferior lid 16 onto the inferior side panel portion 48 and inferior side panel portion 60 one end at a time, i.e., by placing one end over the inferior end of the container 12 and then placing the other end in the first side notch 42 and second side notch 44 afterward.

The inferior end panel 34 extends from the inferior end of the bottom panel 22 by a distance that exceeds the distance by which the first elongate side panel 24 and second elongate side panel 26 extend from the bottom panel 22. The inferior end panel 34 is partially folded over itself to trap edges of the tab 68 and tab 74 to secure the container 12 together. To this end, the inferior end panel 34 includes a double over fold line 76 located at a distance roughly equal to and slightly further than the distance the first elongate side panel 24 and second elongate side panel 26 extend. Thus, the unfolded inferior end panel 34 extends from the inferior end of the bottom panel 22 by the distance necessary to provide a sufficient fold over portion.

The inferior end panel 34 folds over about the double over fold line 76 with the tab 68 and tab 74 trapped under the folded under portion. Glue or adhesive may be used to secure the tab 68 and tab 74 to the inferior end panel 34. Alternatively, fasteners or cabling may be placed through the folded over inferior end panel 34, the tab 68 and tab 74.

Figure 6A:
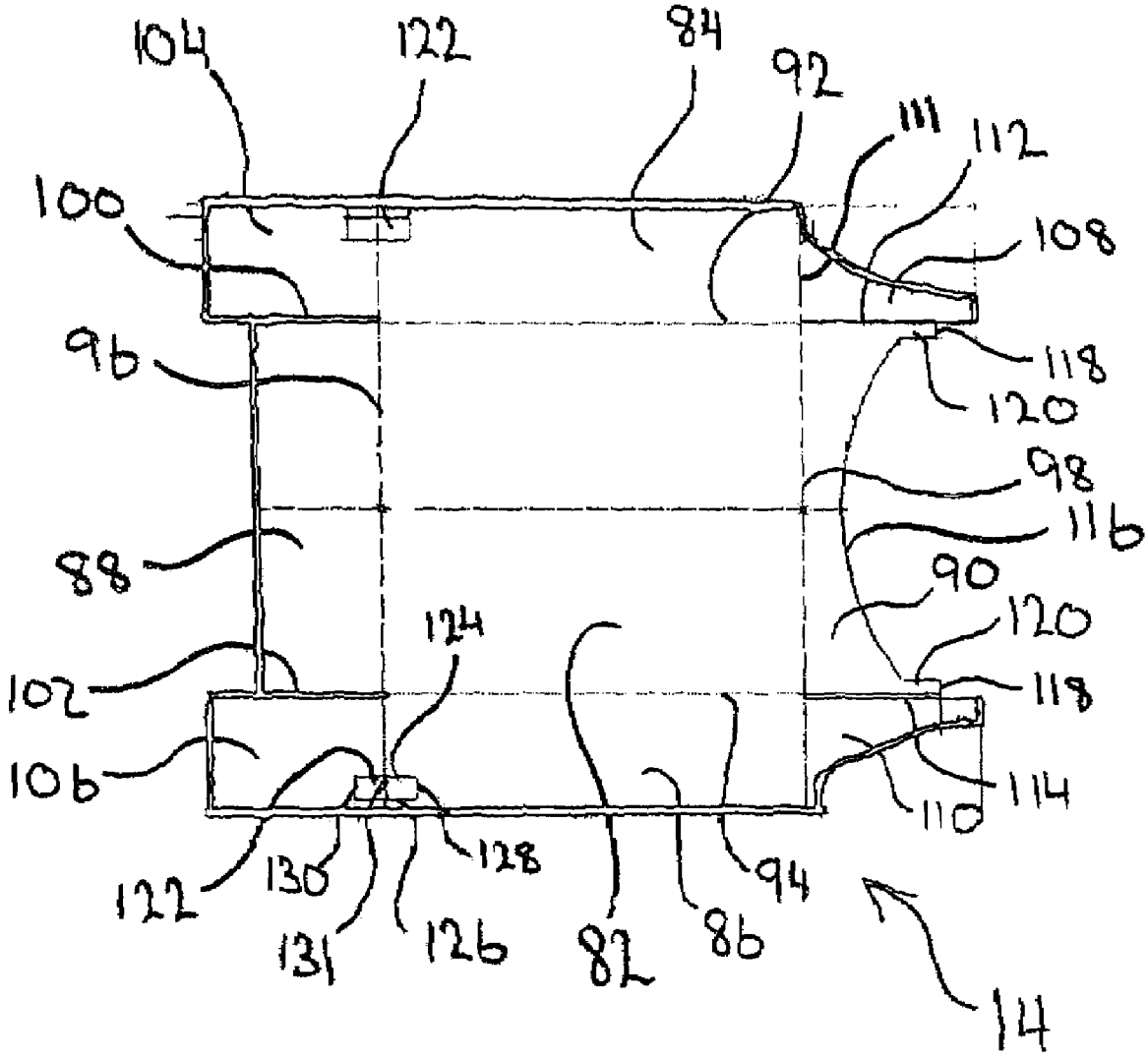
FIG. 6A shows a plan view of the superior lid of the casket of FIG. 1, prior to assembly.

FIG. 6A shows a plan view of the superior lid 14 in an unassembled state. As with the container 12, the superior lid 14 is basically a piece of scored and creased corrugated paper that is folded. The superior lid 14 includes a top panel 82, a first lateral panel 84, a second lateral panel 86, a superior end panel 88 and an intermediate end panel 90. The first lateral panel 84, second lateral panel 86, superior end panel 88 and intermediate end panel 90 are formed by folding portions of the superior lid 14 down from the top panel 82. It is noted that the terms up and down as used herein are generally interchangeable. Generally, however, folding up means that the folded piece extends upward from the piece from which it is folded in the final product, and folding down means the folded piece extends downward from the piece from which it is folded in the final product. However, when such pieces are assembled, they entire piece may be positioned such that "folding up" actually describes folding outward, inward, upward or downward.

In any event, to form the first lateral panel 84, the first lateral panel 84 is folded down from the top panel 82 along first lateral fold line 92. To form the second lateral panel 86, the second lateral panel 86 is folded down from the top panel 82 along second lateral fold line 94. To form the superior end panel 88, the superior end panel 88 is folded down from the top panel 82 along superior end fold line 96. To form the intermediate end panel 90, the intermediate end panel 90 is folded down from the top panel 82 along intermediate end fold line 98. The first lateral panel 84, second lateral panel 86, superior end panel 88, and intermediate end panel 90 are preferably folded down to form a set of planar surfaces that are each perpendicular to the top panel 82.

The first lateral panel 84 further includes a tab 104 extending in a superior direction past the superior end of the top panel 82. The tab 104 is formed by a score 100 between the first lateral panel 84 and the superior end panel 88, and is further created by a fold about an extension of superior end fold line 96. More specifically, the score 100 allows tab 104 to be separated from the superior end panel 88, and tab 104 folds perpendicularly about the extension of superior end fold line 96. The tab 104 has a height that extends to approximately the height of first lateral panel 84. The second lateral panel 86 includes a similar tab 106, formed by a score 102 between the second lateral panel 86 and the superior end panel 88.

The superior end panel 88 has a height substantially equivalent to the height first lateral panel 84. Glue or adhesive may be used to secure the tabs 104 and tab 106 to the superior end panel 88. Alternatively, fasteners or cabling may be used.

Figure 6B:
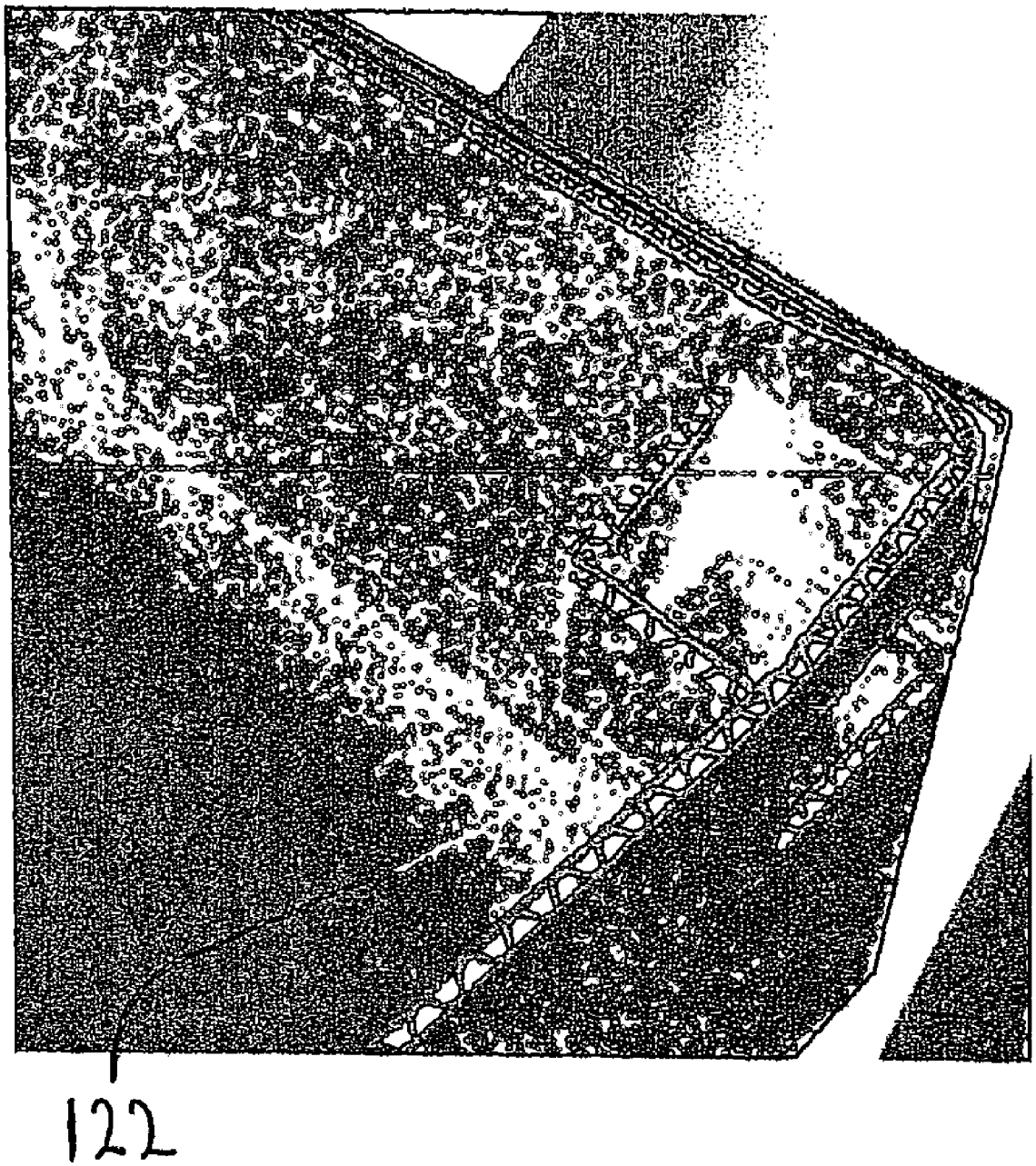
FIG. 6B shows a perspective view of a corner support rib of the assembled superior lid of FIG. 6A.
Figure 7:
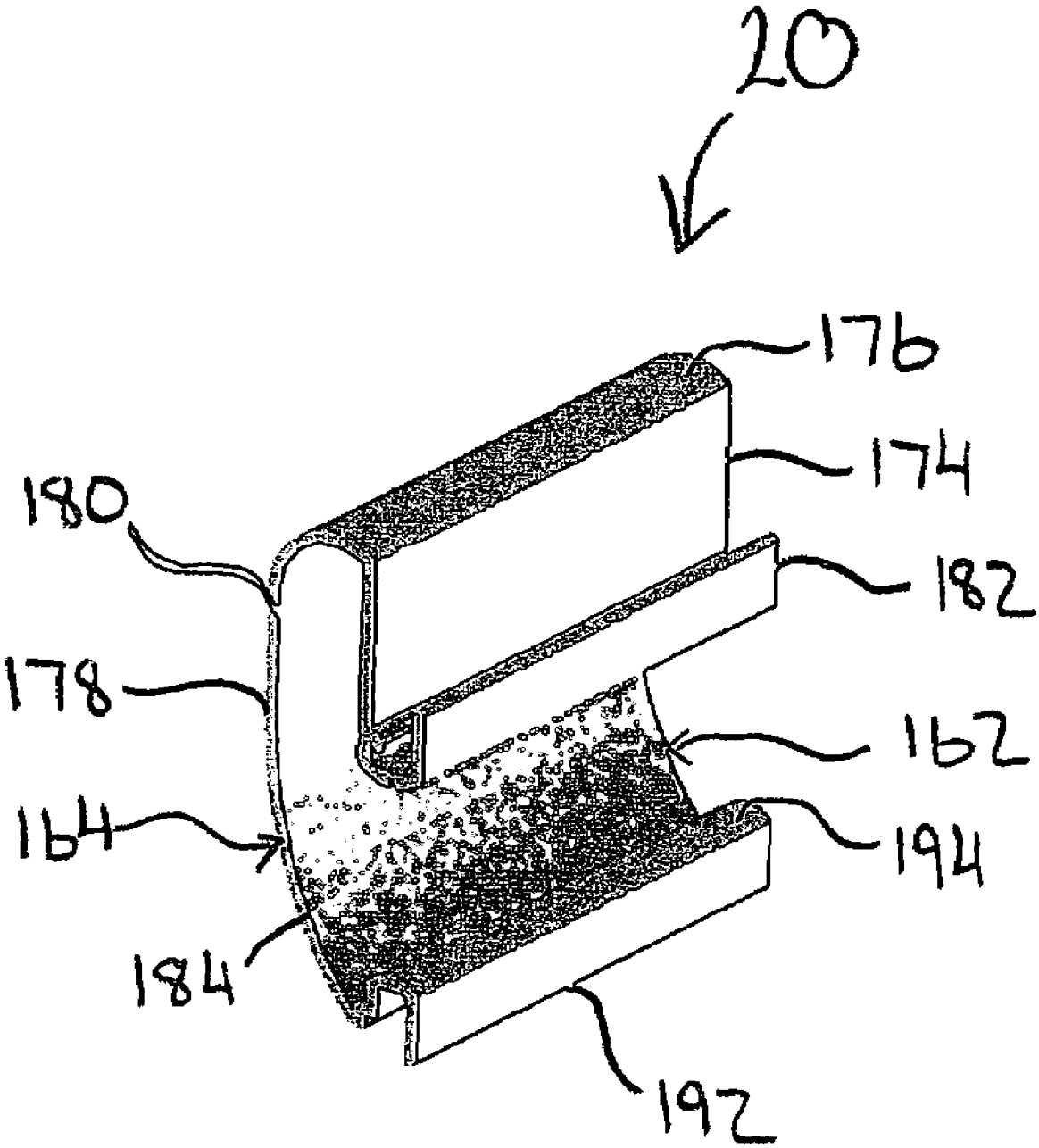
FIG. 7 shows a perspective view of the insertable handle of FIG. 4.

The anterior end of the first lateral panel 84 includes a corner support rib 122 that is formed by a punched through portion of the first lateral panel 84. One corner support rib (not numbered in FIG. 1) is visible in final assembled form on the near corner of the superior lid 14 in FIG. 1. The assembled corner support is shown in FIG. 6B. Referring first to FIG. 6A, the corner support rib 122 is formed by a first score 124, a second score 126, a first fold line 128, a second fold line 130 and a center fold line 131. The first score 124 and second score 126 co-extend parallel to each other and parallel to the second lateral fold line 94. The first score 124 and second score 126 preferably have a length of between about two and five inches, and are roughly centered about the superior end fold line 96 such that a portion of the corner support rib 122 is formed from tab 104. The first score 124 and second score 126 are disposed such that the lower thereof is displaced from the edge of the first lateral panel 84, preferably by no more than an inch or two. The first fold line 128 extends between the first score 124 and the second score 126 at one end of the corner support rib 122 and the second fold line 130 extends between the first score 124 and the second score 126 at the other end of the corner support rib 122. The corner support rib 122 is punched inward forming inward creases at the first fold line 128 and the second fold line 130, and an outward crease midway in between at center fold line 131. The center fold line 131 is an extension of superior end fold line 96, but creases in the opposite direction as the tab 104. As shown in FIG. 6B, the resulting corner support rib 122 is a rectangular or square inward extension or shelf that supports the superior lid 14 on the reduced height superior edge of the container 12 and properly positions the lid with respect to the rest of the container. Without the support rib 122, the superior edge of the superior lid 14 would tend to creep downward over the superior edge of the reduced height superior end of the container 12. With the support rib 122, the top of the superior lid is rests parallel with the inferior lid in the finally assembled container. A similar corner support rib 122 is formed on the second lateral panel 86. Placement of the superior lid 14 on the container 12 is explained in further detail below.

The intermediate end panel 90 extends from the inferior end of the top panel 82 and forms a flat panel with a concavity. The concavity provides room through which the torso of the deceased may pass in the low profile aspect of the casket assembly 10. While the concavity is shown to be an arcuate curve in the embodiment described herein, the concavity may be other types of curves, or a polygonal shaped indentation or cutout, such as a rectangular, pentagonal, other type of cut-out that allows room for the torso. In the exemplary embodiment described herein, the concavity is formed by an arched cut-out 116 disposed between two vertical extensions 120 at either outside edge of the intermediate end panel 90. Preferably, the further inward extreme of the arched cut-out 116 (or other concavity) is displaced from the intermediate end fold line 98 to enhance the structural integrity of the superior lid 14. Moreover, the vertical extensions 120 also preferably extend to the same length as the adjoining lateral panels 84 and 86 for better strength and to facilitate retention of the superior lid 14 on the container 12.

It is noted that the first lateral panel 84 also includes a tab 108 extending from the first lateral panel 84 in the inferior direction past the inferior end of the top panel 82. The tab 108 is formed by a score 112 between the panel that forms the intermediate end panel 90 and the extending portion of the first lateral panel 84. The tab 108 is further created by a fold 111 about an extension of the intermediate end fold line 98. The score 112 allows the tab 108 to separate from intermediate end panel 90 along the score and fold perpendicularly about fold 111. The tab 108 has a shape that, when folded inward to mate with the intermediate end panel 90, conforms to the shape of the intermediate end panel 90. Thus, the tab 108 includes a portion that corresponds to the vertical extension 120 and a part of the arched cut-out 116. The second lateral panel 86 includes a similar tab 110 formed in the same way.

Glue or adhesive may be used to secure the tab 108 and tab 110 to the intermediate end panel 90. Alternatively, fasteners or cabling may be placed through the intermediate end panel 90, tab 108 and tab 110.

Figure 5:
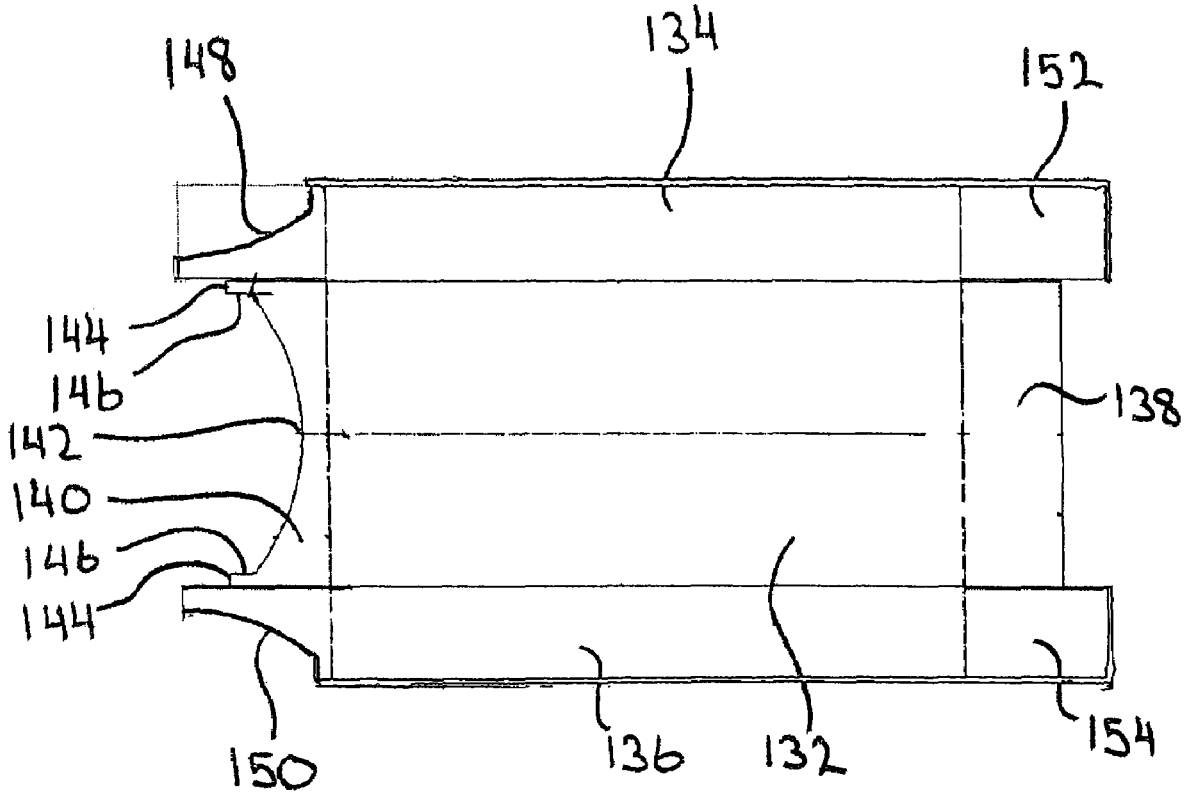
FIG. 5 shows a plan view of the inferior lid of the casket of FIG. 1, prior to assembly.

FIG. 5 shows a plan view of the inferior lid 16 in an unassembled state. As with the superior lid 14, the inferior lid 16 is basically a piece of scored and creased corrugated paper that is folded. The inferior lid 16 includes a top panel 132, a first lateral panel 134, a second lateral panel 136, an inferior end panel 138 and an intermediate end panel 140. The first lateral panel 134, second lateral panel 136, inferior end panel 138 and intermediate end panel 140 are all formed by folding portions of the inferior lid 16 down from the top panel 132.

The first lateral panel 134 further includes a tab 152 extending in an inferior direction past the superior end of the top panel 132. The second lateral panel 136 includes a similar tab 154. The tabs 152 and 154 have heights substantially equivalent to the height of inferior end panel 138. Glue or adhesive may be used to secure the tabs 152 and 154 to the inferior end panel 138. Alternatively, fasteners or cabling may be used.

The intermediate end panel 140 extends from the superior end of the top panel 132 and forms a flat panel with a concavity similar to the concavity of the intermediate end panel 90 of the superior lid 14. The concavity provides room through which the torso of the deceased may pass in the low profile aspect of the casket assembly 10. As discussed above, the concavity may be other types of curves, or a polygonal shaped indentation or cutout, such as a rectangular, pentagonal, other type of cut-out that allows room for the torso. In the embodiment described herein, the concavity is formed by an arched cut-out 142 disposed between two vertical extensions 144. Preferably, the further inward extreme of the arched cut-out 142 (or other concavity) is displaced from the fold line that forms the intermediate end panel 140 in order to enhance the structural integrity of the inferior lid 16. The vertical extensions 144, like the vertical extensions 120, preferably extend-down to the edge of the adjoining lateral panels 134 and 136.

It is noted that the first lateral panel 134 also includes a tab 148 extending from the first lateral panel 134 in the superior direction past the superior end of the top panel 132. The tab 148 has a shape that, when folded inward to mate with the intermediate end panel 140, conforms to the shape of the intermediate end panel 140. Thus, the tab 148 includes a portion that corresponds to the vertical extension 144 and a part of the arched cut-out 142. The second lateral panel 136 includes a similar tab 150 formed in the same way.

Glue or adhesive may be used to secure the tab 148 and 150 to the intermediate end panel 140. Alternatively, fasteners or cabling may be placed through the intermediate end panel 140, tab 148 and tab 150.

To place the superior lid 14 on the container 12, the superior lid 14 is situated on top of the container 12 such that the first lateral panel 84 of the superior lid 14 is adjacent to and outside of the superior side panel portion 46 of the container 12, the second lateral panel 86 is adjacent to and outside of the superior side panel portion 58, the superior end panel 88 is adjacent to and outside of the superior end panel 32, and the ends 118 of the vertical extensions 120 are generally received by the first side notch 42 and second side notch 44 which extend just below double over fold lines 50 and 62 in the assembled container. One corner support rib 122 rests on top of the corner between the superior side panel portion 46 and the superior end panel 32, and the other corner support rib 122 rests on top of the corner between the superior side panel portion 58 and the superior end panel 32.

To place the inferior lid 16 on the container 12, the inferior lid 16 is situated on top of the container 12 such that the first lateral panel 134 is adjacent to and outside of the inferior side panel portion 48, the second lateral panel 136 is adjacent to and outside of the inferior side panel portion 60, the inferior end panel 138 is adjacent to and outside of the inferior end panel 34, and the vertical extensions 144 are generally received by the first side notch 42 and second side notch 44.

FIGS. 4A-4D and 7 show the insertable handle 20 which may be used in suitable rectangular cutouts (the openings 18) located at various positions in the first elongate side panel 24 and second elongate side panel 26. (See FIG. 1). The insertable handle 20 includes a first end 162 and a second end 164 and preferably has a substantially uniform profile throughout its length between the first end 162 and the second end 164. Accordingly, the insertable handle 20 in the preferred embodiment may be formed by extrusion. However, at least advantages of the present invention may be obtained even if the insertable handle 20 is not uniform along its length or formed by extrusion.

The insertable handle 20 includes an upper panel seating structure 166, a lower panel seating structure 168, and a handle body 170 extending therebetween. The upper panel seating structure 166 is configured to engage a top (downward facing) edge of the opening 18 and the lower panel seating structure 168 is configured to engage a bottom (upward facing) edge of the opening 18. In particular, the upper panel seating structure 166 includes an outer upward extension 182 that extends up along the outside of a casket panel, a inner upward extension 186 that extends up along the inside of a casket panel, and a bottom connector 184 that connects the outer upward extension 182 and the inner upward extension 186. The outer upward extension 182, the bottom connector 184 and the inner upward extension 186 form a U-shaped channel 188 in which the top edge of the opening 18 may fit. The U-shaped channel 188 further includes a barb 190 configured to deform or penetrate the casket panel to assist in securing the upper panel seating structure 166 to the top edge of the opening 18.

The lower panel seating structure 168 includes an outer downward extension 192 that extends down the outside of a casket panel, an inner downward extension 196 that extends down the inside of a casket panel, and a top connector 194 that connects the outer downward extension 192 and the inner downward extension 196. The outer downward extension 192, the top connector 194 and the inner downward extension 196 form an inverted U-shaped channel 198 in which the bottom edge of the opening 18 may fit. The inner downward extension 196 transitions to the handle body 170 via a relief elbow 200. The relief elbow 200 provides extra corners that facilitate bending to allow the insertable handle 20 to be deformed during the handle insertion process.

The handle body 170 extends from the inner upward extension 186 to the relief elbow 200 in a generally concave manner, forming a concave interior 172. The concave interior 172 receives the gripping fingers/hands of a person handling the casket assembly 10. The handle body 170 forms a barrier between the hands/fingers of a person using the insertable handle 20 and the remains of the deceased in the interior of the container 12. In the embodiment described herein, the handle body 170 further includes an extended finger receptacle 180 on the inside of the container 12, still protected by the barrier, but which provides a more substantial gripping position, allowing the weight to be borne by the portions of the fingers closer to the palm, and not the portions near the finger tips. Specifically, with extra room for the fingers within the extended finger receptacle, the inner portions of the fingers will engage the weight bearing portion (the bottom connector 184).

To create the finger receptacle 180 in the embodiment described herein, the handle body 170 includes an upright extension 174 that extends vertically upward from the inner upward extension 186 of the upper panel seating structure 166. The handle body 170 further includes a top 176 that extends more or less toward the interior of the casket from the upright extension 174, preferably in an arcuate manner, until reaching a largely vertical protective extension or wall 178. The protective extension or wall 178 extends from well above (typically an inch or more) the primary load bearing portion (e.g. bottom connector 184) of the insertable handle 20 to the relief elbow 200.

It will be appreciated that at least some of the advantages of the insertable handle 20 may be obtained in a casket even without the extended finger receptacle 180. Similarly, at least some of the advantages of the extended finger receptacle 180 may be obtained in the inventive handle used outside of the casket industry. Indeed, the inventive features of the handle 20 describe herein may be obtained using such a handle on any panel having an opening and in which a barrier may be necessary.

With reference now to FIGS. 8-21, an alternative embodiment of a casket incorporating aspects of the invention is shown. In particular, the embodiment shown in FIGS. 8-21 discloses a casket having a plurality of pieces that are joined using a mortise and tenon fastening arrangement. Like the embodiment shown in FIGS. 1-7, the mortise and tenon casket shown in FIGS. 8-21 is a relatively light-weight casket that may be manufactured relatively inexpensively. In one embodiment, the mortise and tenon casket is constructed of wood to provide a unique, aesthetically pleasing appearance. However, the mortise and tenon casket may be constructed of metal or other materials sufficiently rigid to withstand the stresses of a mortise and tenon fastening arrangement.

Figure 8:
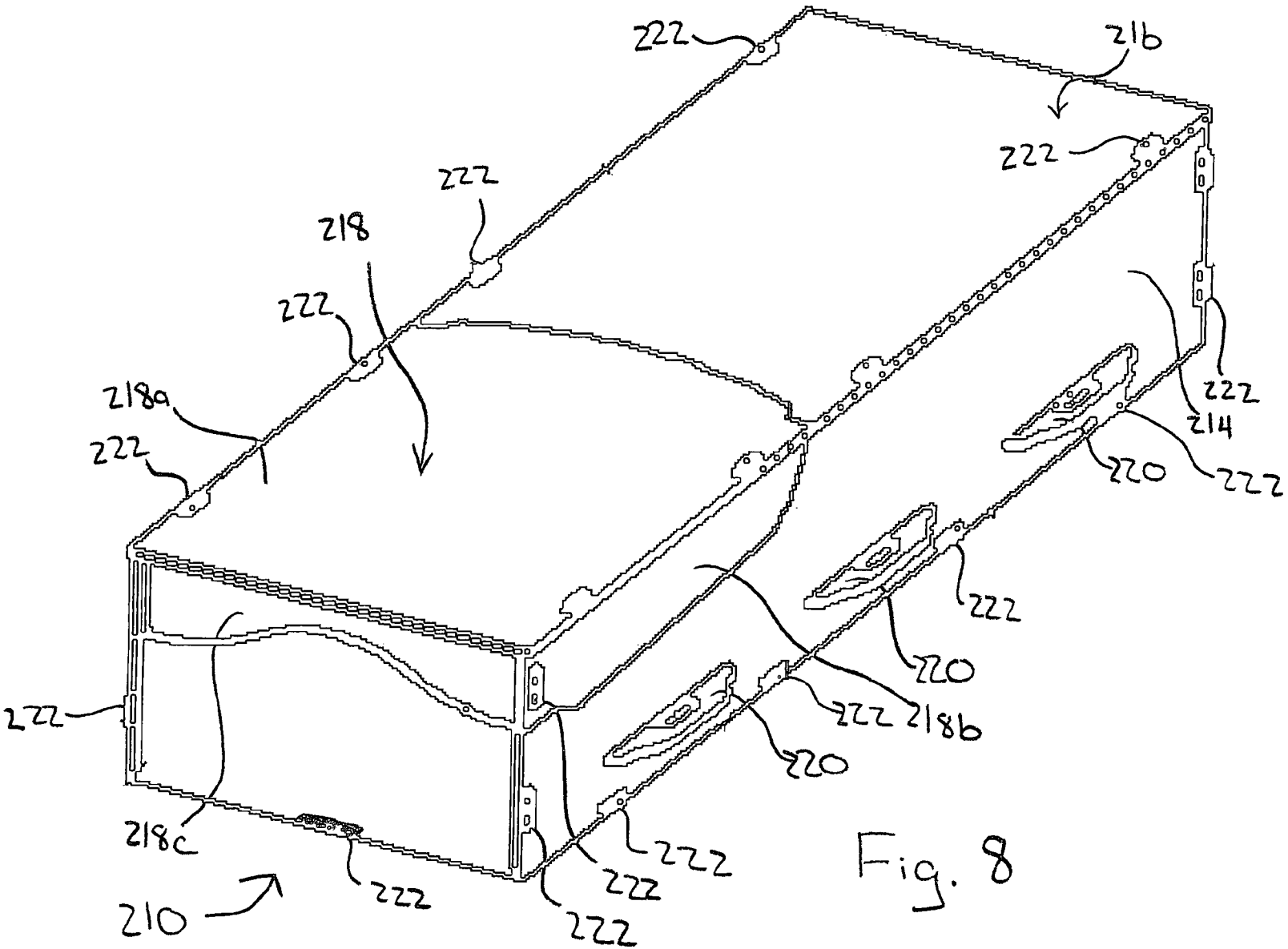
FIG. 8 shows a top perspective view of an exemplary mortise and tenon casket.
Figure 9:
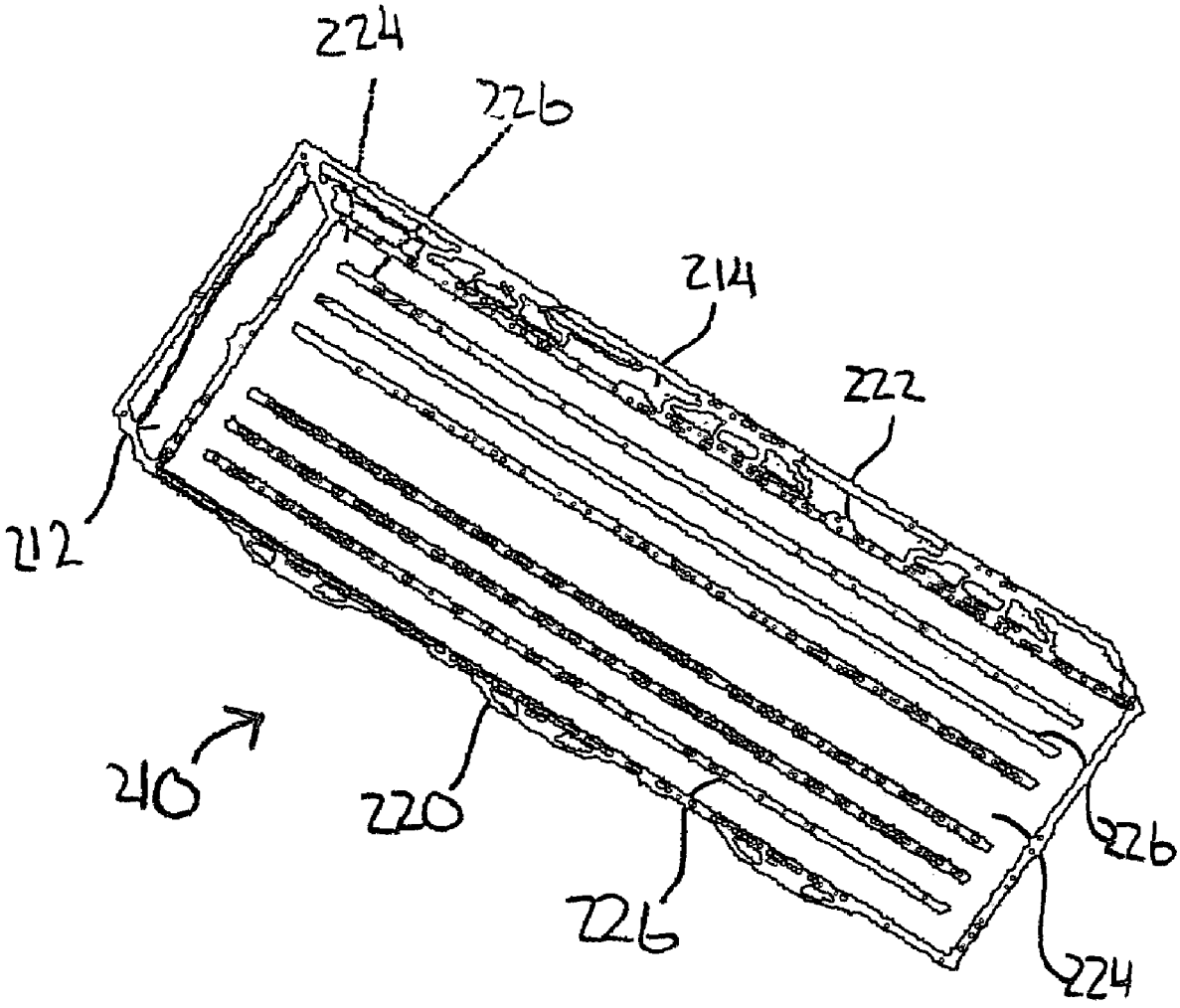
FIG. 9 shows a bottom perspective view of the casket of FIG. 9.

FIG. 8 shows a top perspective view of a mortise and tenon casket 210 incorporating aspects of the invention. The casket 210 comprises a plurality of panels (e.g. 212, 214, and 224) assembled into a container, a first lid 218 and a second lid 216. As shown in FIGS. 8 and 9, the container comprises a head end panel 212, a first side panel 214, a foot end panel 236 located opposite the head end panel (see FIG. 10), a second side panel 214 located opposite the first side panel 214 (which is a mirror image of the first side panel 214 and shown in FIG. 16), and a bottom panel 224. Thus, the container of the casket 210 is basically a rectangular box.

The first lid 218 is preferably a removable lid or a pivotally attached lid, and is disposed over a portion of the container in which the head and torso of the deceased would reside. The first lid 218 is constructed of a top panel 218*a* (see FIG. 12), two lateral panels 218*b* (see FIG. 14) and a head end panel 218*c* (see FIG. 13).

Figure 15:
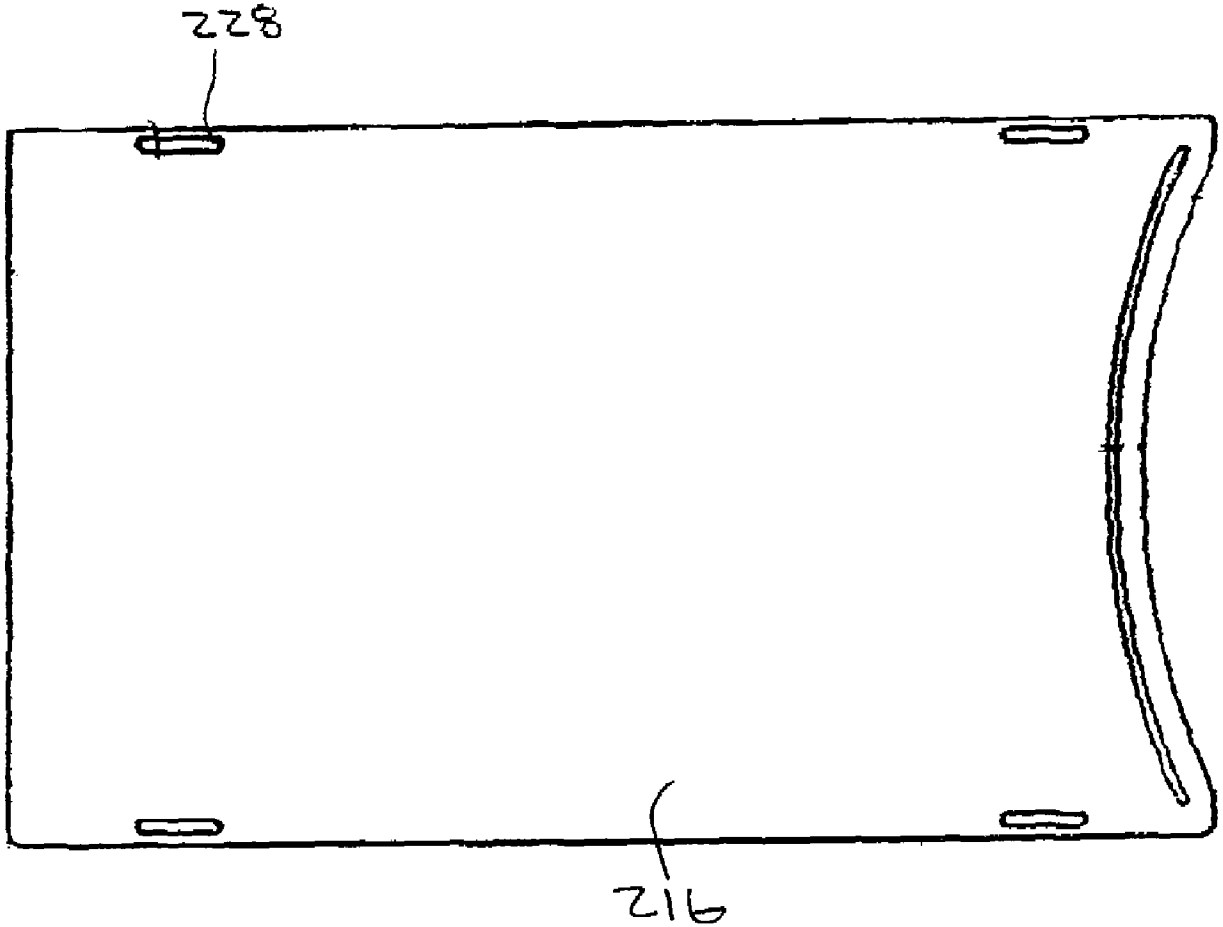
FIG. 15 shows a plan view of a top panel of a second lid of the casket of FIG. 8.

The second lid 216 is a single panel that is secured to the container and is not generally intended to be opened for showing or identification of the deceased. FIG. 15 shows in further detail the second lid 216.

One advantage of the casket 210 of FIGS. 8-21 is the construction using mortise and tenon features, referred to herein respectively as holes 228 and tabs 222. In general, one or more panels include one or more tabs 222 that are received by holes 228 of mating panels. The tabs 222, extend outward from one or more edges of the panels (See e.g. FIGS. 10, 11, 13, 14, 17) and the holes 228 extend through the panel from one side to the other side. The holes 228 are typically disposed proximate to, but displaced from an edge of the panel (See e.g. FIGS. 10, 11, 12, 15 and 16). The holes 228 are oblong and slot-like in shape and dimensioned to snugly receive the tabs 222 through the holes 228.

In the embodiment described herein, each tab 222 includes a protrusion body 232 and a pinhole 234. (See e.g. FIGS. 10, 11 and 13). The protrusion body 232 extends outward from the edge of the panel, and the pinhole 234 extends from one side of the protrusion body 232 to the opposite side of the protrusion body 232. When the protrusion body 232 of a tab 222 of a first panel is disposed through a corresponding hole 228 of a second panel, the pinhole 234 and the first panel on which it is located are disposed on opposite sides of the second panel. The pinhole 234 is configured to receive a retention pin 280.

Figure 19:
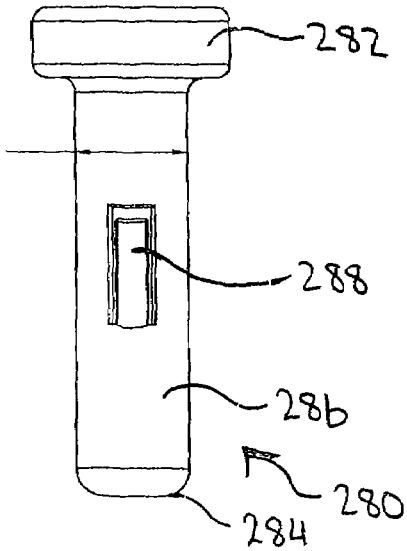
FIG. 19 shows a front plan view of an exemplary fastener that may be used in the casket of FIG. 8.
Figure 20A:
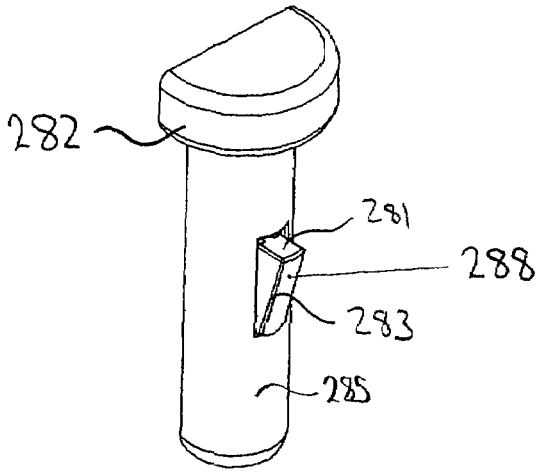
FIG. 20A shows a front perspective view of the fastener of FIG. 19.
Figure 20B:
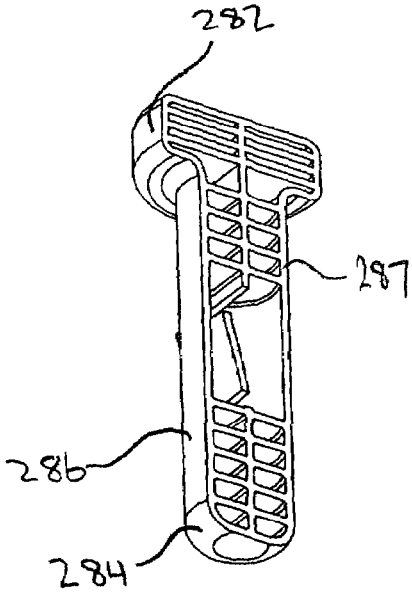
FIG. 20B shows a rear perspective view of the fastener of FIG. 19.
Figure 20C:
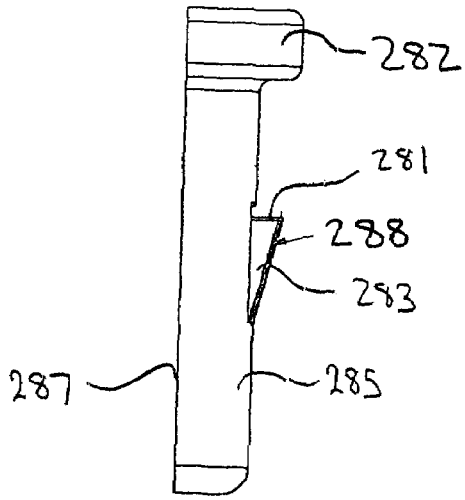
FIG. 20C shows a side plan view of the fastener of FIG. 19.
Figure 21:
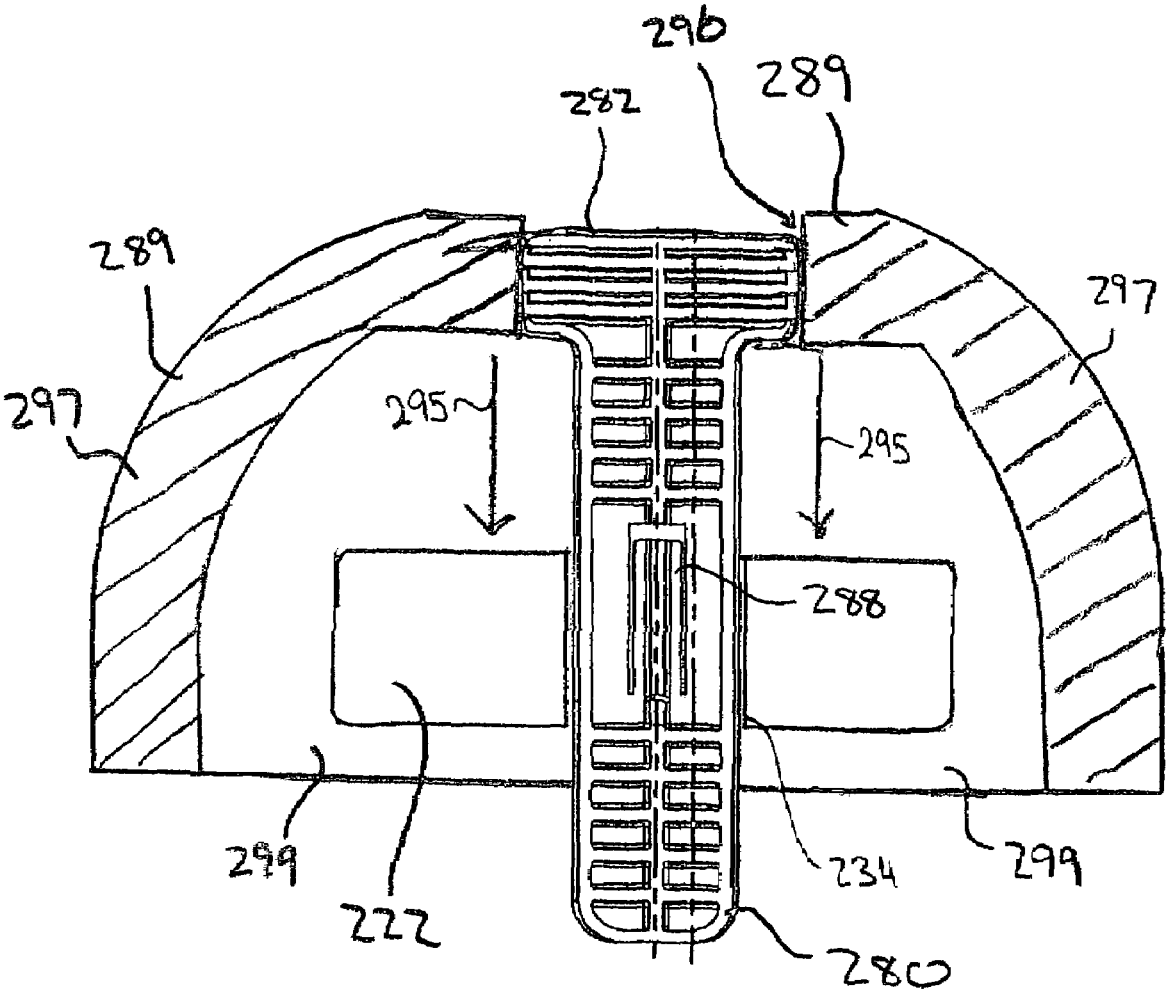
FIG. 21 shows a cutaway view of the fastener of FIG. 19 with an added decorative skirt.

The retention pin 280 is secured within the pinhole 234 and is configured to inhibit de-insertion movement of the protrusion body 232 back through the hole 228. To this end, and as shown in FIGS. 19-21, the retention pin 280 preferably includes a head 282 and a retention barb 288 that traps the retention pin 280 within the pinhole 234. More specifically, as shown in FIGS. 19-21, the retention pin 280 includes a head 282 attached to a semi-circular shaft 286 that extends from the head 282 to the distal end 284. The semi-circular shaft 286 includes a curved front portion 285 and a flat rear portion 287. The shaft 286 includes a retention barb 288 in the form of an outward biased, pivotally attached, inclined extension formed from the side of the shaft 286. A spring is used to bias the barb 288 outward from the shaft 286. However, it will be appreciated that the barb 288 may take other forms or be biased in other ways. For example, the barb may be biased in another manner, such as using a resilient material that allows the barb to flex, but return to its original position following flexing. The barb includes a top ledge 281 and a tapered body 283. The retention pin may be made of a number of materials, including wood, metal and plastic. In one embodiment, the pin is made of a plastic material and is formed by injection molding.

FIG. 21 shows a cross section of the retention pin 280 partially inserted into a pinhole 234 of a tab 222. The retention pin 280 shown in FIG. 21 is designed to be fully inserted into the pinhole 234 of the tab 222 in the direction of arrows 295. In order to insert the pin 280 into the pinhole 234, the flat rear portion 287 of the pin 280 is placed against a first panel having a hole 228 with a tab 222 from a second panel inserted through the hole. The distal end 284 of the pin 280 is then moved in to the pinhole 234. As the pin 280 is moved downward in the direction of arrows 295, the tapered body 283 of the barb 288 moves into the pinhole 234, gradually compressing the barb inward so the barb is substantially contained within the shaft 286 of the pin. Once the top ledge 281 of the barb 288 moves past the bottom edge of the pinhole 234, the pin 280 is fully engaged, and the biased barb 288 snaps back outward away from the shaft 286. This causes the top ledge 281 of the barb to be positioned against the bottom shelf of the tab 222, preventing the pin 280 from moving out of the pinhole 234 unless the barb is subsequently compressed back into the shaft by an outside agency.

As also shown in FIG. 21, the retention pin 280 may further include a head shroud 289 that extends down and around from the head 282. The head shroud may have a decorative surface that serves to mask the underlying tab 222 and/or the pin 280 itself. In one embodiment, the head shroud 289 includes a top head hole 296 designed to fit over the pin head 282. However, the shroud may be attached to the pin in any of a number of different manners, and may completely cover the head, as will be readily recognized by one of skill in the art. As shown in FIG. 21, the shroud includes a flared skirt 298 that is substantially hemispherical. The flared skirt 298 includes a flat rear portion 297 and a curved decorative front portion 299. The flat rear portion 297 is designed to fit against the planar surface of a casket panel. The curved front portion 299 covers the pin and associated tab. In one embodiment, the flared skirt 298 is sufficiently sized to completely cover the tab 222. However, the flared skirt 298 may be any of several sizes, depending upon the desired amount of coverage from the shroud. In this manner, further decorative features may be added to the casket with little additional cost.

Referring again to the general assembly of the panels, the bottom panel 224 (see FIGS. 9 and 17) includes ten tabs 222, and otherwise has a generally planar, rectangular shape. Four tabs 222 extend from an outer periphery on each of the long sides and one tab 222 extends from the outer periphery on each end. The tabs 222 of the one long side of the bottom panel 224 are received into four corresponding holes 228 of the container side panel 214. The holes 228 of the container side panel 214 are disposed proximal to the bottom edge of the container side panel 214 (see FIG. 16). The tabs 222 of the other long side of the bottom panel 224 are received by corresponding holes 228 on the other side panel, which is the mirror image the container side panel 214.

Figure 16:
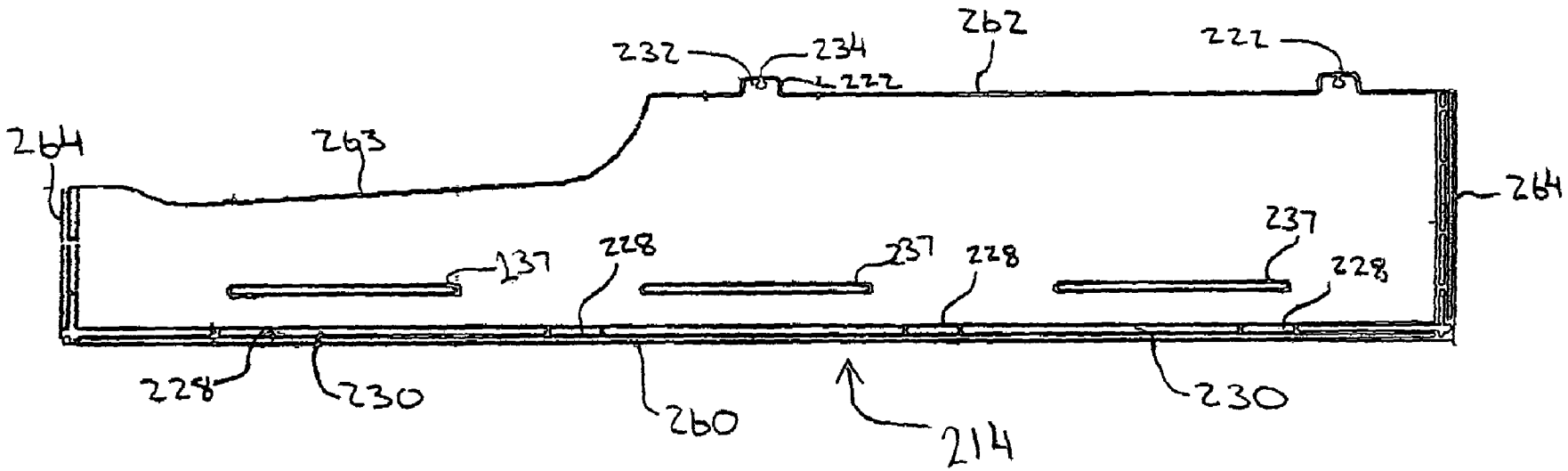
FIG. 16 shows a plan view of a side panel of the container of the casket of FIG. 8.
Figure 17:
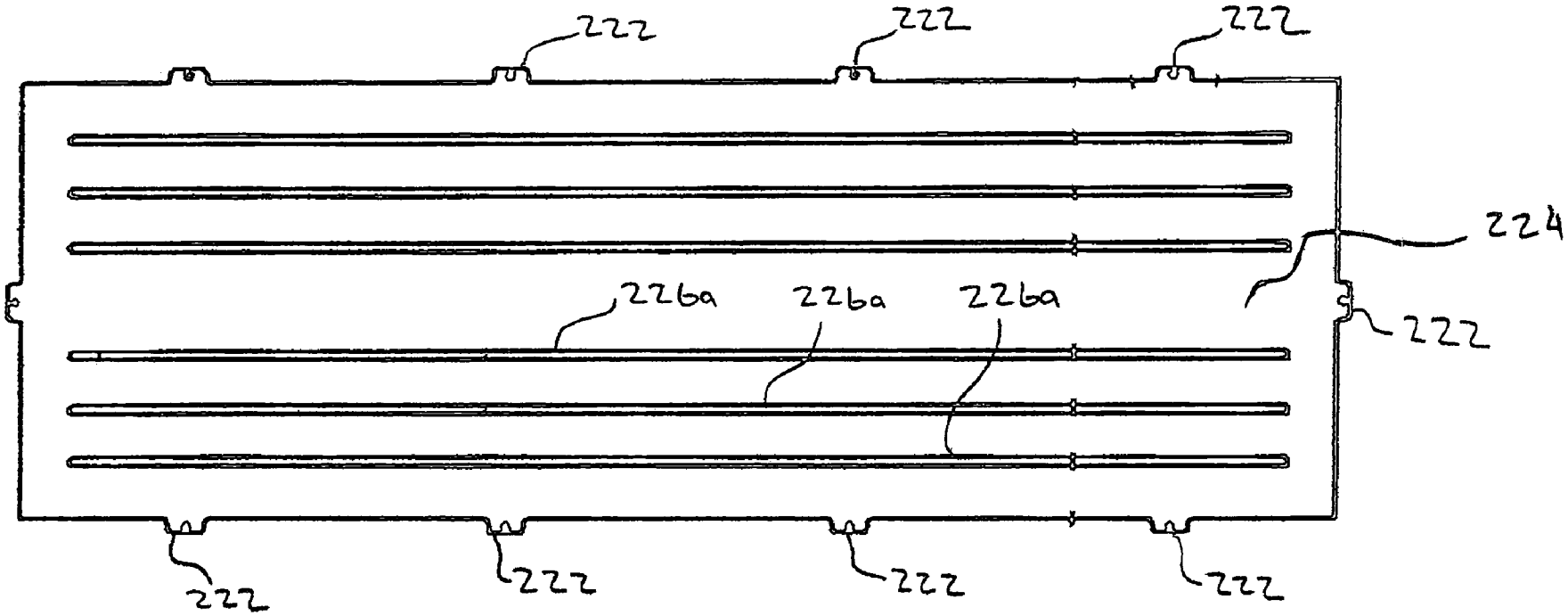
FIG. 17 shows a bottom plan view of the bottom panel of the container of the casket of FIG. 8.

FIG. 16 shows the opposing side panel 214, which is the mirror image of the side panel 214 of FIG. 8. FIG. 16 shows the internal side of the side panel 214. In general, the container side panel 214 has four edges, including a bottom edge 260, a top edge 262 and two side edges 264. The bottom edge 260 is elongated and generally extends the length of the bottom panel 224. The top edge 262 has the same direct length as the bottom edge, but includes a recessed portion 263 towards the head end of the casket 210. The recessed portion 263 has a lower height than that provided at the foot end of the side panel. The recessed portion 263 gradually tapers down from the full height of the side panel, and is not completely uniform, thereby providing a decorative edge for the side panel. The two side edges 264 of the container side panel extend from the bottom edge to the top edge.

The recessed portion 263 of the top edge 262 of the container side panel 214 allows for less obstructed viewing of the head of the deceased when the first lid 218 is removed. Many prior art caskets do not have a recessed head end, but rather use an elevation mechanism to raise the head and torso upwards to enable viewing unobstructed by the casket side panels. Once the viewing is over, the elevation mechanism is used to permanently lower the head and torso back into the casket. In the embodiment of FIGS. 8-21, the side panel 214 has a reduced height portion in order to reduce or eliminate the need for a mechanical elevation system, thereby reducing relative casket cost.

As discussed above, the container side panel 214 includes four holes 228 that receive tabs of the bottom panel 224. In the embodiment described herein, the four holes 228 are disposed within a linear channel 230 within the inside of the container side panel 214. (See FIG. 16). The channel 230 extends into, but not through, the container side panel 214 and is configured to receive the corresponding edge of the bottom panel 224. The holes 228 are disposed within the channel 230. Thus, the edge of the bottom panel 224 fits within the channel 230 and the tabs 222 of the bottom panel 224 extend through the holes 228 within the channel 230.

Figure 18A:
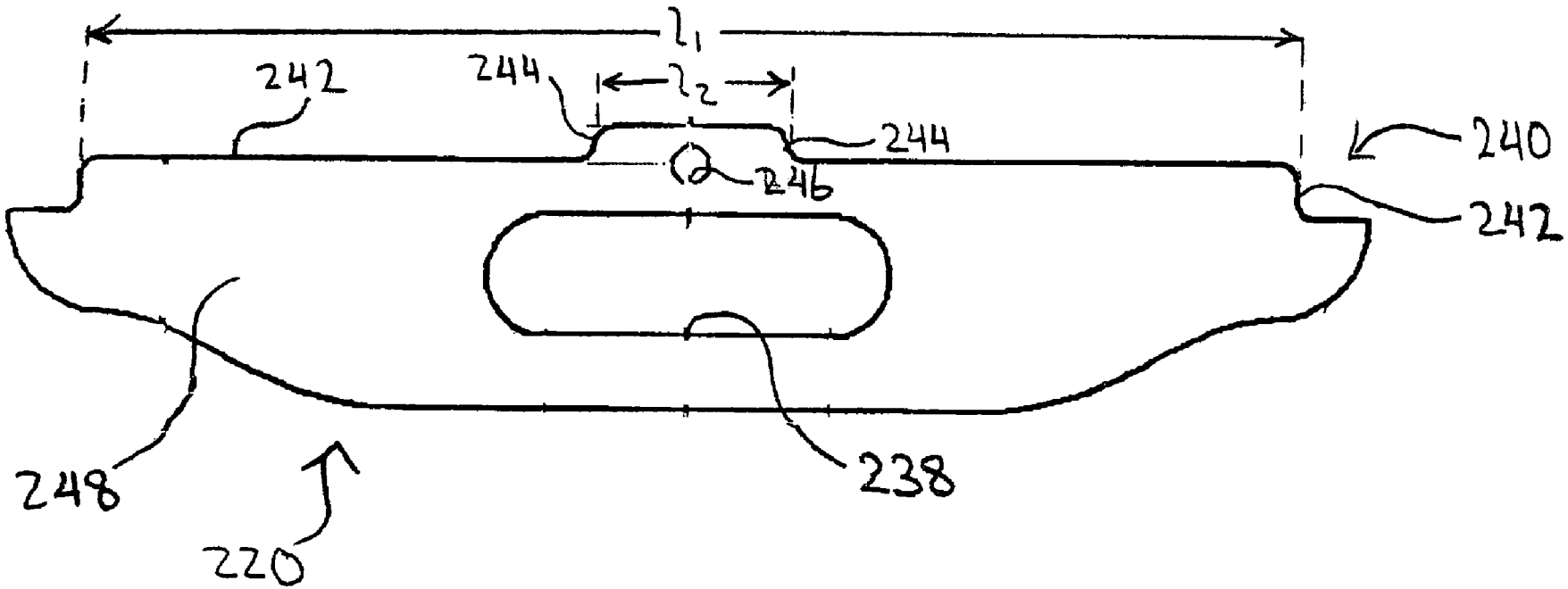
FIG. 18A shows a top plan view of a handle of the casket of FIG. 8.

The container side panel 214 further comprises enlarged handle holes 237 for receiving shouldered tabs 240 of the casket handles 220. (See FIGS. 8 and 18A). As shown in FIG. 18A, each casket handle 220 is a generally elongate piece having an exterior flange or shelf 248, the shelf 248 containing an oval gripping hole 238 disposed therein. The gripping hole 238 is wide enough to accommodate the hand of a pallbearer and the shelf 248 is (in this embodiment) approximately three times as long as the gripping hole 238. On one side of the gripping hole 238, the side that is intended to fit within a handle hole 237 (see FIG. 16), is a shouldered tab 240 that is received by the handle hole 237. The shouldered tab 240 is at least twice as wide (i.e. long) and preferably many times the width (length) of the ordinary tabs 222. Specifically, the shouldered tab 240 includes a wide shoulder 242 that extends inward from the shelf 248 and to the extent that it extends at least partly and preferably all the way through the handle hole 236. Extending further inward from the wide shoulder 242 is a tab extension 244. The tab extension 244 has a size and shape similar to the tab 222, and includes a pinhole 246. The shoulder 242 is preferably more than twice the length of the tab extension 244 (i.e., $l_1>2l_2$). The tab extension 244 is disposed on the inside of the container side panel 214 and the shelf is disposed on the outside of the container side panel 214. A pin is inserted through the pinhole 246 on the interior of the casket when assembled. The handle 220 includes the shouldered tab 240 for extra strength to allow the casket 210 to be lifted by the handles 220.

Figure 18B:
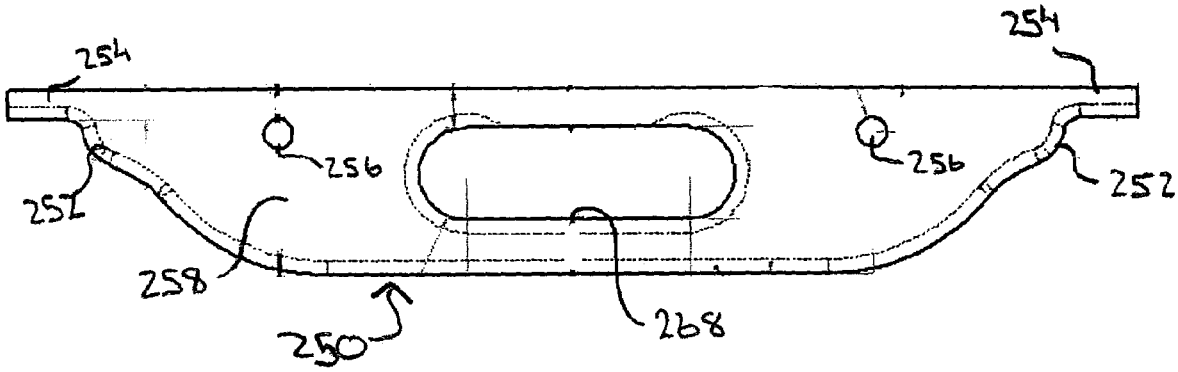
FIG. 18B shows a top plan view of an alternative handle for use with the casket of FIG. 8

With reference to FIG. 18B, an alternative handle 250 is shown. The handle 250 includes a handle shelf 258, a gripping hole 268. The handle 250 also includes two pinholes 256 positioned on either side of the gripping hole 268. A wide shoulder 252 is formed by the handle with two flanges 254 extending outward from the wide shoulder 252. When assembled on the casket, the flanges 254 are disposed on the inside of the container side panel 214 and the shelf 258 is disposed on the outside of the container side panel 214 with the pinholes 256 partially exposed on the outside of the side panel. Pins are inserted into the pinholes 256 to secure the handle 250 to the side panel.

Referring again to the container side panel 214 shown in FIG. 16, two tabs 222 extend from the non-recessed portion of the top edge 262 of the container side panel 214. These tabs 222 are received by corresponding holes 228 in the second lid 216. Referring to the second lid 216 shown in FIG. 15, the second lid 216 includes four holes 228, with two holes on each side of the lid. Each set of two holes 228 is positioned to receive tabs 222 from one of the two container side panels 214.

Referring again to FIG. 17, the bottom panel 224 also includes a set of runners 226*a* that extend in a parallel manner approximately the length of the bottom panel 224. The runners 226*a* may be formed of wooden strips that fit within channels in the bottom panel 224. The runners 226*a* are provided to allow for better incineration of the casket 210 as well as to facilitate movement of the casket 210 over rollers in a hearse. As is evident from FIGS. 16 and 17, the bottom panel 224 in the embodiment described herein will sit above the lower-most edges of the container side panels 214. The runners 226*a* provide an extension of the bottom panel 224 that extends below the lower-most edges of the container side panels 214. Without the runners 226*a*, the bottom panel 224 would not correctly engage the rollers typically used in hearses to move the casket 210 in and out of the hearse. The runners 226*a* also elevate the bottom panel 224 within a cremation furnace, which provides for better incendiary characteristics for the casket 210.

As discussed above, the bottom panel 224 further includes a tab 222 at each of its end edges. The tab 222 on the head end edge is received by a hole 228 in the head end panel 212 (see FIGS. 8 and 11). The corresponding hole 228 in the head end panel 212 is also disposed within a channel 230 that is slightly displaced from and runs parallel to the bottom edge of the head end panel 212. The channel 230 in the head end panel 212 receives the head end edge of the bottom panel 224. The head end panel 212 further includes two tabs 222, one on each upright edge of the head end panel 212, that are configured to engage holes 228 within each of the container side panels 214 (shown but not enumerated in FIG. 16).

Figure 10:
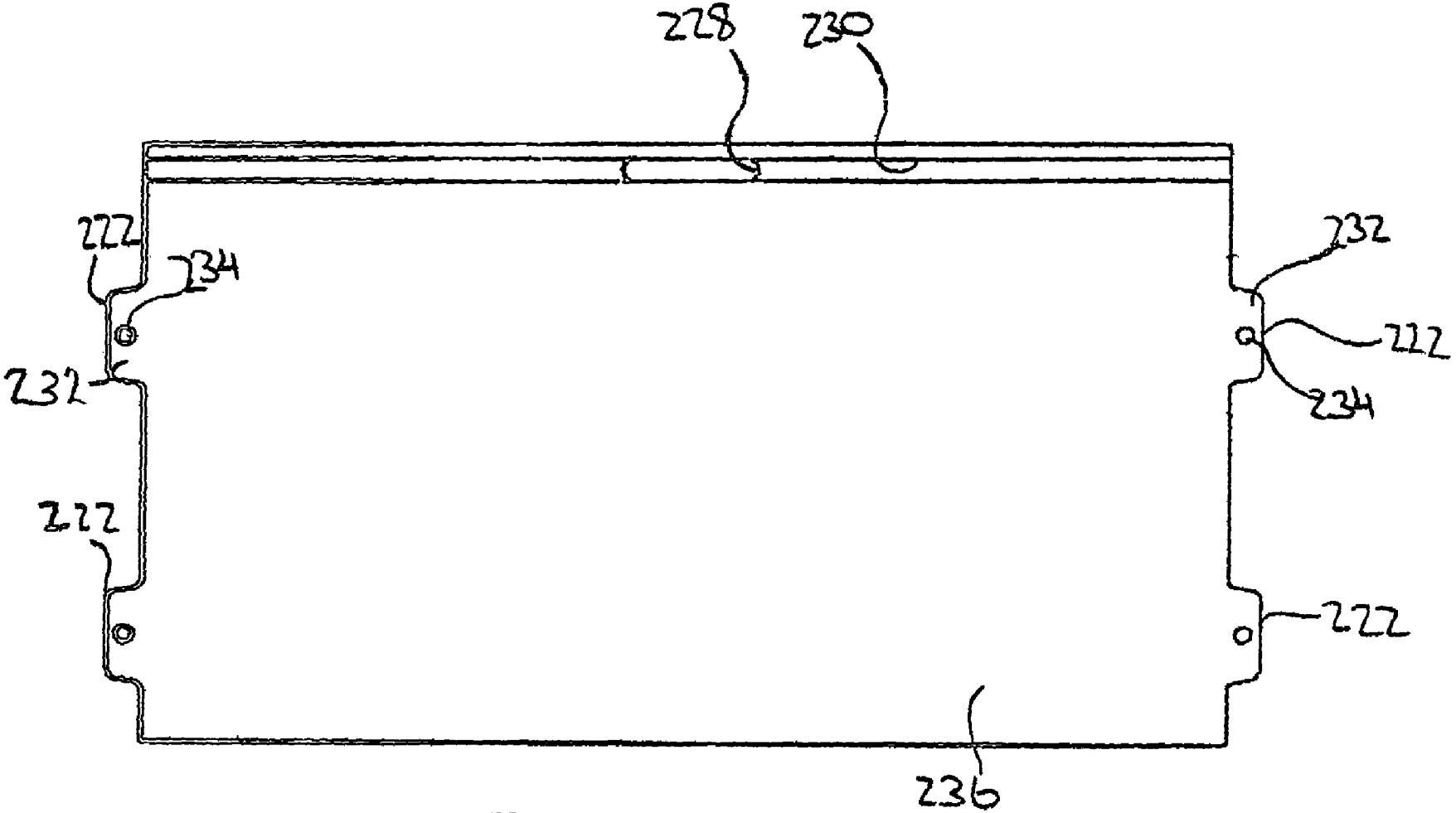
FIG. 10 shows an inverted plan view of a foot end panel of the container of the casket of FIG. 9.
Figure 11:
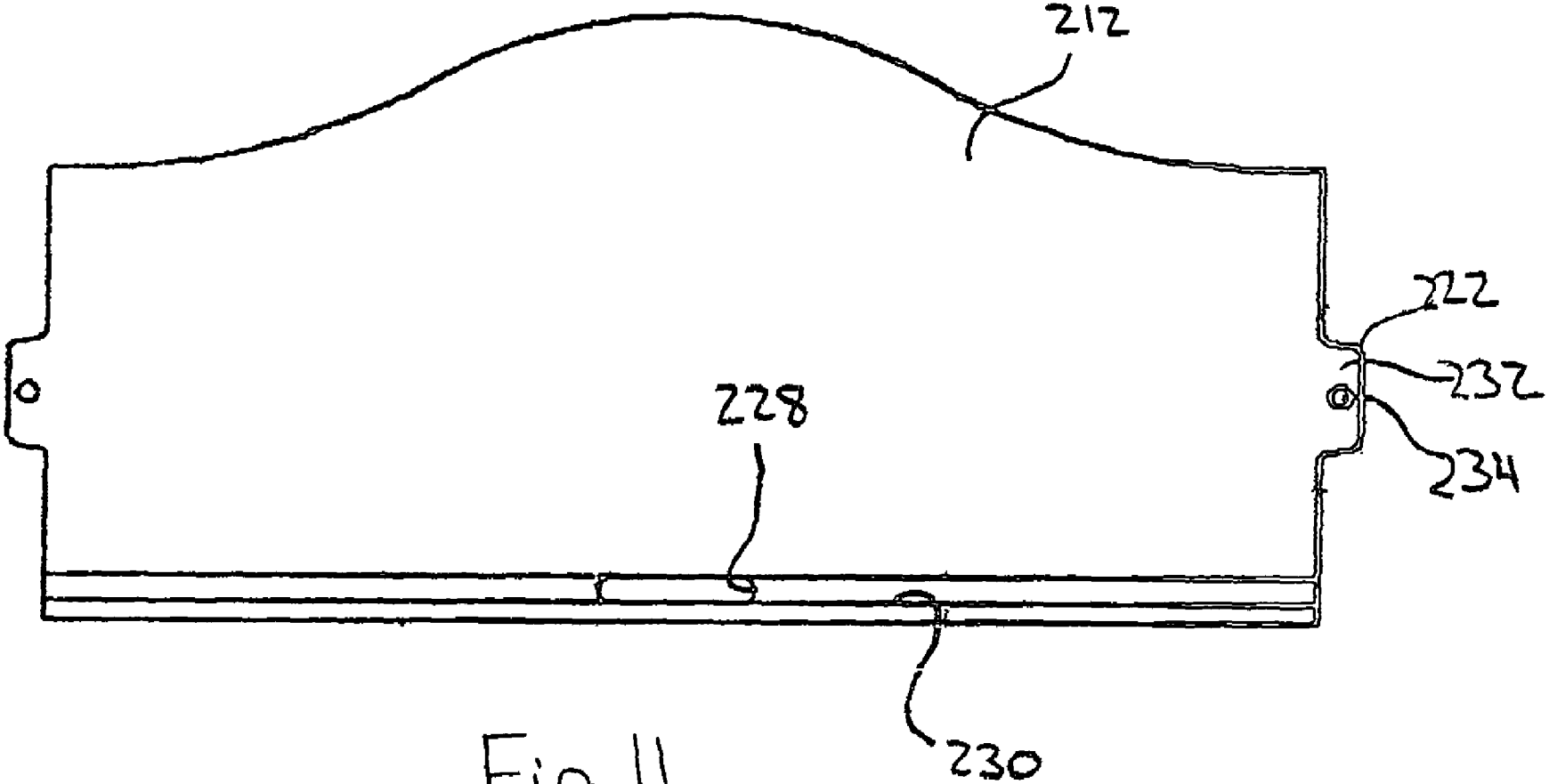
FIG. 11 shows a plan view of a head end panel of the container of the casket of FIG. 8.

Referring again to the bottom panel 224, the tab 222 on the foot end edge is received by a hole 228 in the foot end panel 236 (see FIG. 10, where the foot end panel 236 is shown upside-down). The corresponding hole 228 in the foot end panel 236 is also disposed within a channel 230 that is slightly displaced from and runs parallel to the bottom edge of the foot end panel 236. The channel 230 in the foot end panel 236 receives the foot end edge of the bottom panel 224. The foot end panel 236 further includes four tabs 222, two on each upright edge of the foot end panel 236 that are configured to engage holes 228 within each of the container side panels 214 (shown but not enumerated in FIG. 16).

Accordingly, the above described casket assembly includes two side panels 214, a foot end panel 236, a head end panel 212 and a second lid 216, all connected via a series of tabs 222 and holes 228 disposed within a channel of a panel. The above described casket assembly further includes a plurality of handles 220. Each of the tab 222 and hole 228 connections described above preferably employs a retention pin 280 disposed through the pinhole 234 of each tab 222, as discussed above with reference to FIGS. 19-21.

Figure 12:
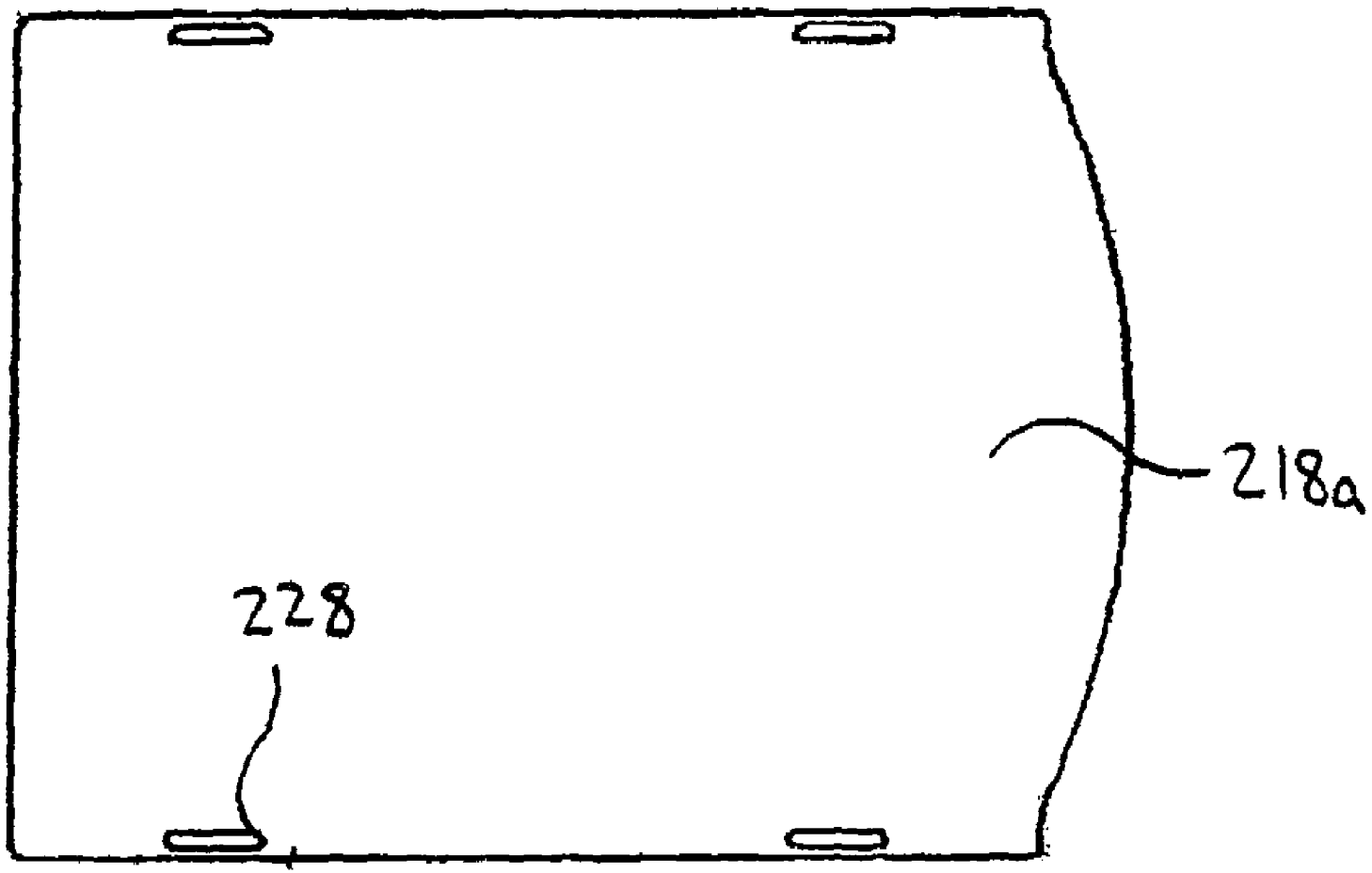
FIG. 12 shows a top plan view of a top panel of a first lid of the casket of FIG. 8.
Figure 13:
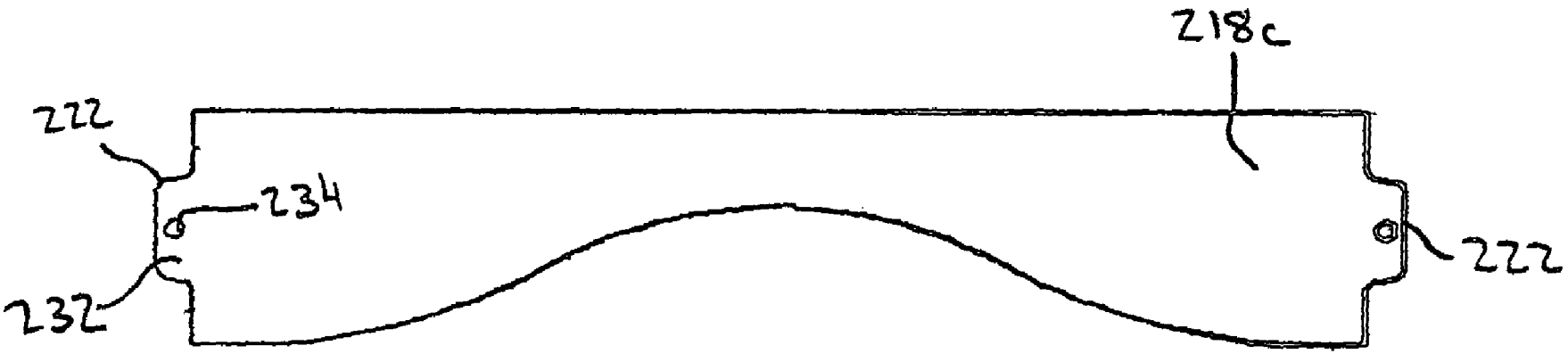
FIG. 13 shows a plan view of a head end panel of the first lid of the casket of FIG. 8.
Figure 14:
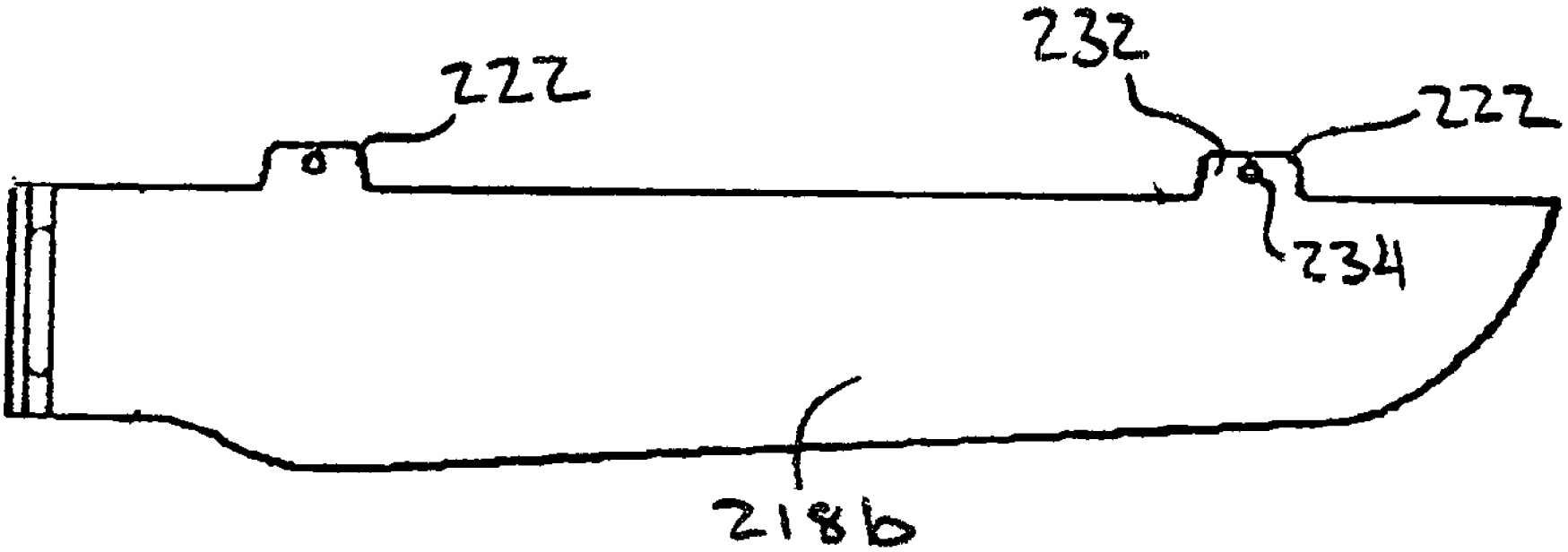
FIG. 14 shows a plan view of a lateral panel of the first lid of the casket of FIG. 8.

Returning again to the first lid 218 for the casket assembly, as shown in FIGS. 12-14, the first lid 218 includes a top panel 218*a*, two lateral panels 218*b*, and a head end panel 218*c*. It is noted that while the second lid 216 does not include downward-extending lateral panels, the first lid 218 includes downward extending panels 218*b* and 218*c* because the head end of the casket 210 is recessed with respect to the foot end. The first lid 218 includes downward extending panels 218*b* and 218*c* in order to elevate the top panel 218*a* off of the recessed portion of the container side panels 214 such that the top panel 218*a* is generally aligned with the second lid 216.

The two lateral panels 218*b* (see e.g. FIG. 14) and the head end panel 218*c* (see FIG. 13) are affixed to the top panel 218*a* using a series of tabs 222, holes 228 and at least some channels 230. FIGS. 13 and 14 show one exemplary arrangement of the series of tabs 222, holes 228 and channels 230.

The assembled first lid 218 may connect to the container by simply placing the lid over the head end of the side panels 214 and the head end panel 212 as shown in FIG. 8. Small tabs, flanges and/or other features, not shown, may be used to hold the assembled first lid 218 in place. In an alternative embodiment, the assembled first lid 218 may be pivotally attached to one of the side panels 214 of the container using metal hinges or the like.

The material for the various panels is preferably 0.5" to 0.625" particle board or plywood. However, numerous other materials may be used in construction of the panels. For example, solid wood or metal may be used. Preferably, the various panels are constructed from a substantially hard and/or rigid material such that the stress on the panels created by the pins at the mortise and tenon joints does not structurally damage the panels.

Figure 22:
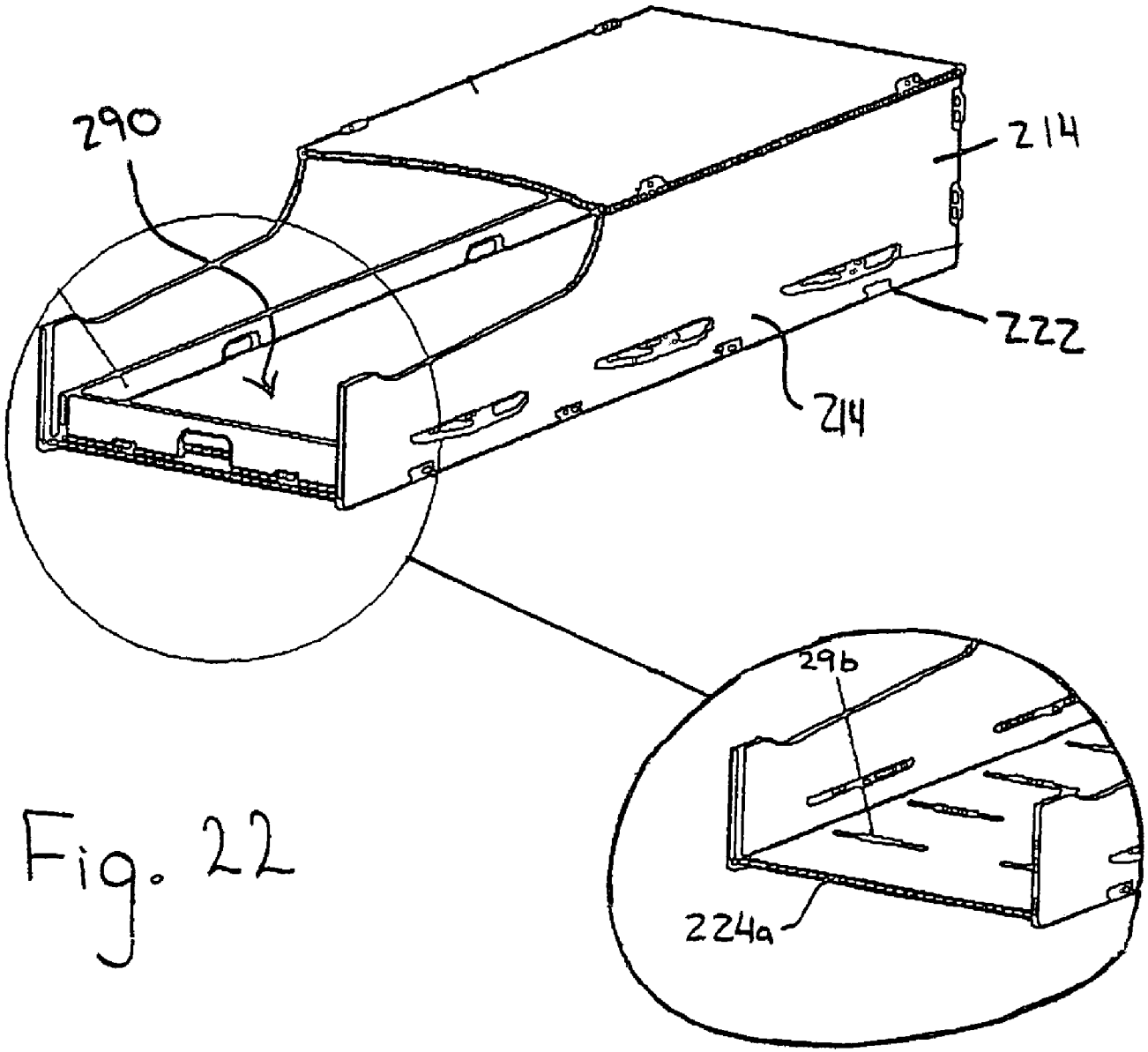
FIG. 22 shows an alternative embodiment of the casket of FIG. 8 with the first lid and head end panel removed, and with a slide out tray according to certain aspects of the invention.
Figure 23:
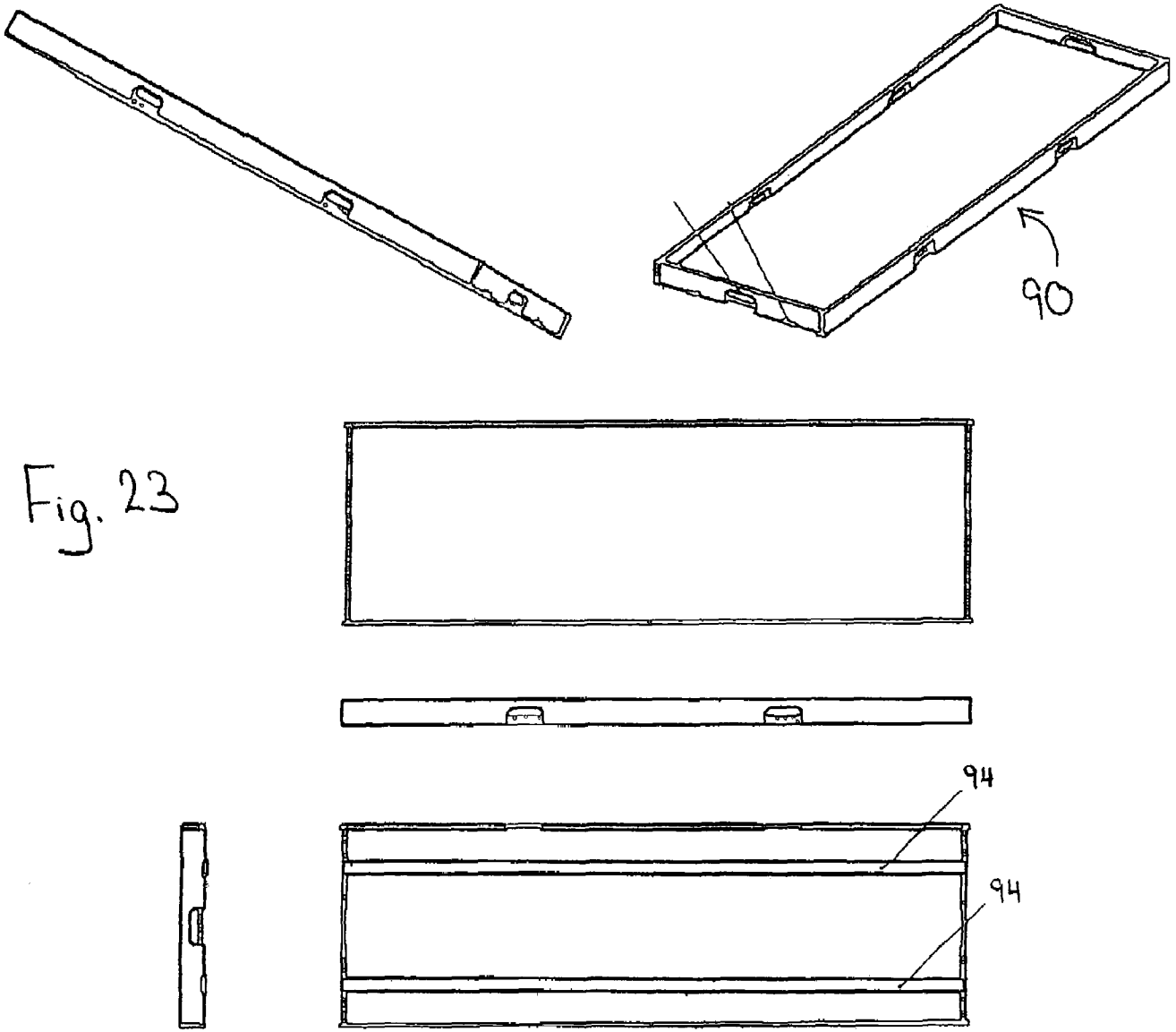
FIG. 23 shows a plurality of views of the slide out tray of FIG. 22.

In one alternative embodiment, the casket 210 further includes a removable tray 290. The removable tray 290 provides a support for the deceased that may be removed prior to cremation. By removing the tray 290 with the deceased, the entire casket 210 need not be consumed during the cremation process. FIG. 22 shows a modified version of the casket 210 with the head end panel 212 and the first lid 218 removed to reveal the tray 290 in place. The tray 290 is shown apart from the casket 210 in FIG. 23. The tray 290 has a bottom panel and four low profile side panels extending upward from each of the four sides of the bottom panel. The bottom panel of the tray 290 is slightly smaller in length and width than the bottom panel 224 of the casket 210. As a consequence, the tray 290 easily fits within the casket 210.

Figure 24A:
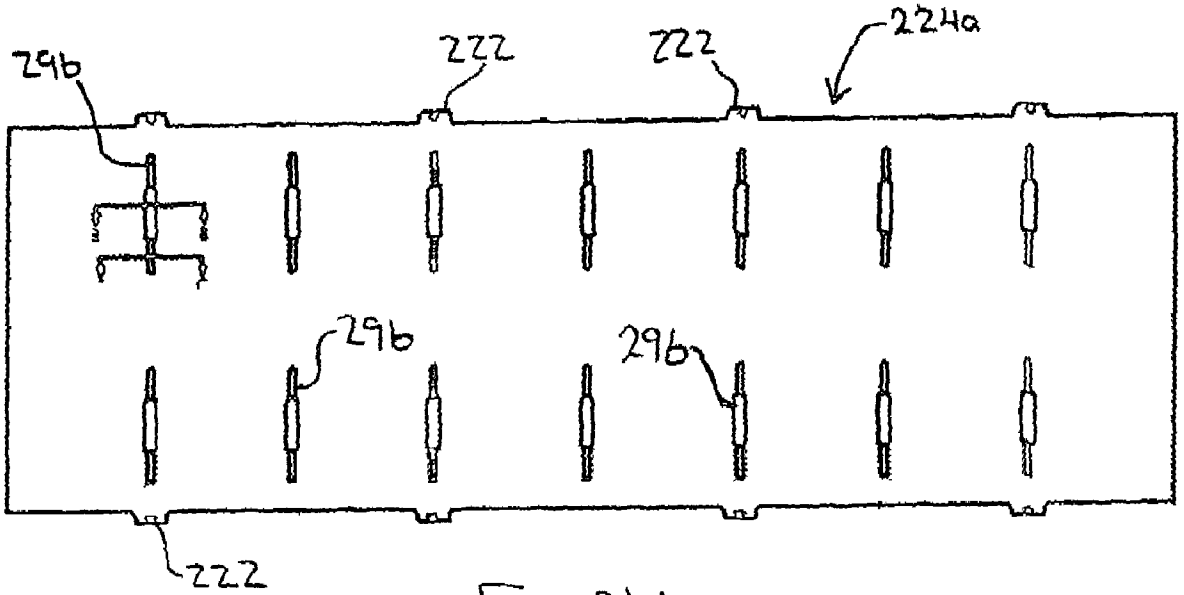
FIG. 24A shows a top plan view of the bottom panel of the container of the casket of FIG. 22.
Figure 24B:
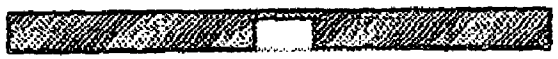
FIG. 24B shows a cross-sectional view of a recess in the bottom panel along line B-B of FIG. 24A.
Figure 24C:
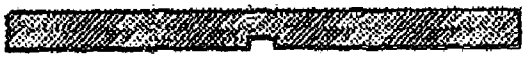
FIG. 24C shows a cross-sectional view of a recess in the bottom panel along line C-C of FIG. 24A.
Figure 25:
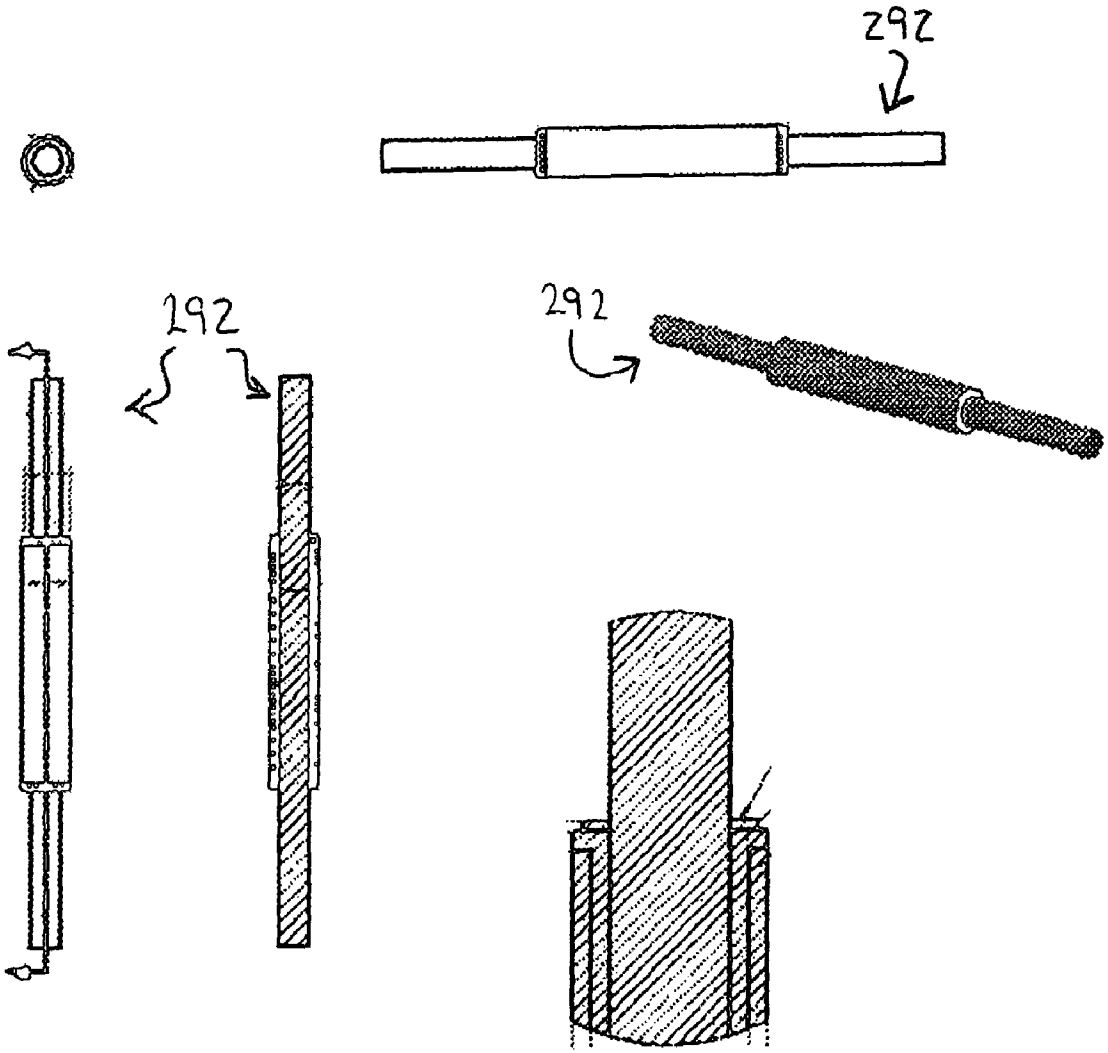
FIG. 25 shows a number of views of a roller for use in the casket of FIG. 22.

The bottom of the tray 290 (See FIG. 23) includes a pair of runners 294 which run approximately the length of the tray and are parallel to each other and parallel to the long edge of the tray 290. The runners 294 may suitably be elongate pieces of wood disposed within corresponding channels cut into the bottom of the tray 290. To facilitate sliding the tray 290 in and out of the casket, the casket includes a modified bottom panel 224*a*. The modified bottom panel 224*a* may suitably be similar to the bottom panel 224 except that the modified bottom panel 224*a* includes a number of rollers 292 (see FIG. 22) disposed within corresponding recesses 296 (see FIG. 24) of the bottom panel 224*a*. The rollers 292, when disposed within the recesses 296 are aligned to receive the runners 294 of the tray 290. In operation, the runners 294 sit atop of the rollers 292. When the tray 290 is moved, the runners 294 roll across the rollers 292.

It will be appreciated that the above describe embodiments are merely exemplary, and that those of ordinary skill in the art may readily devise their own implementations and adaptations that incorporate the principles of the present invention and fall within the spirit and scope thereof. For example, while the placement of the tabs 222, holes 228 and channels 230 is particularly advantageous in the embodiment shown, at least some of the advantages of the present invention may be obtained even if the arrangement of tabs 222 and holes 228 are substantially different.

With reference now to FIGS. 26-32, an alternative embodiment of a casket incorporating aspects of the invention is shown. In particular, the embodiment shown in FIGS. 26-32 discloses a casket having a bracket assembly 300 that may be used to support a display shelf 302. The bracket assembly 300 may also be used to provide a support for a removable casket lid 304, such as the removable lids 14 and 218, discussed previously.

Figure 26:
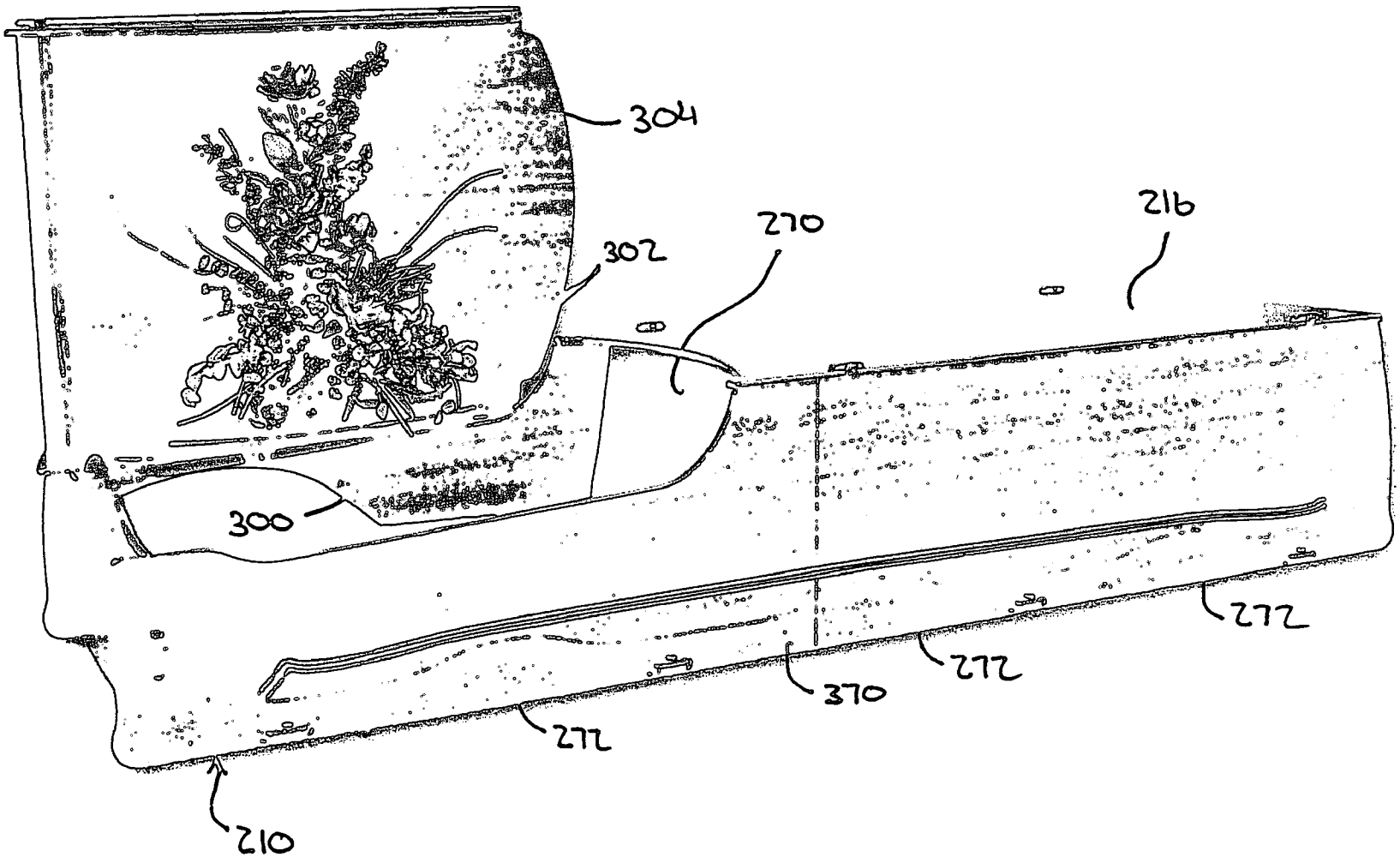
FIG. 26 shows a perspective view mortise and tenon casket including a bracket assembly and display shelf.
Figure 27:
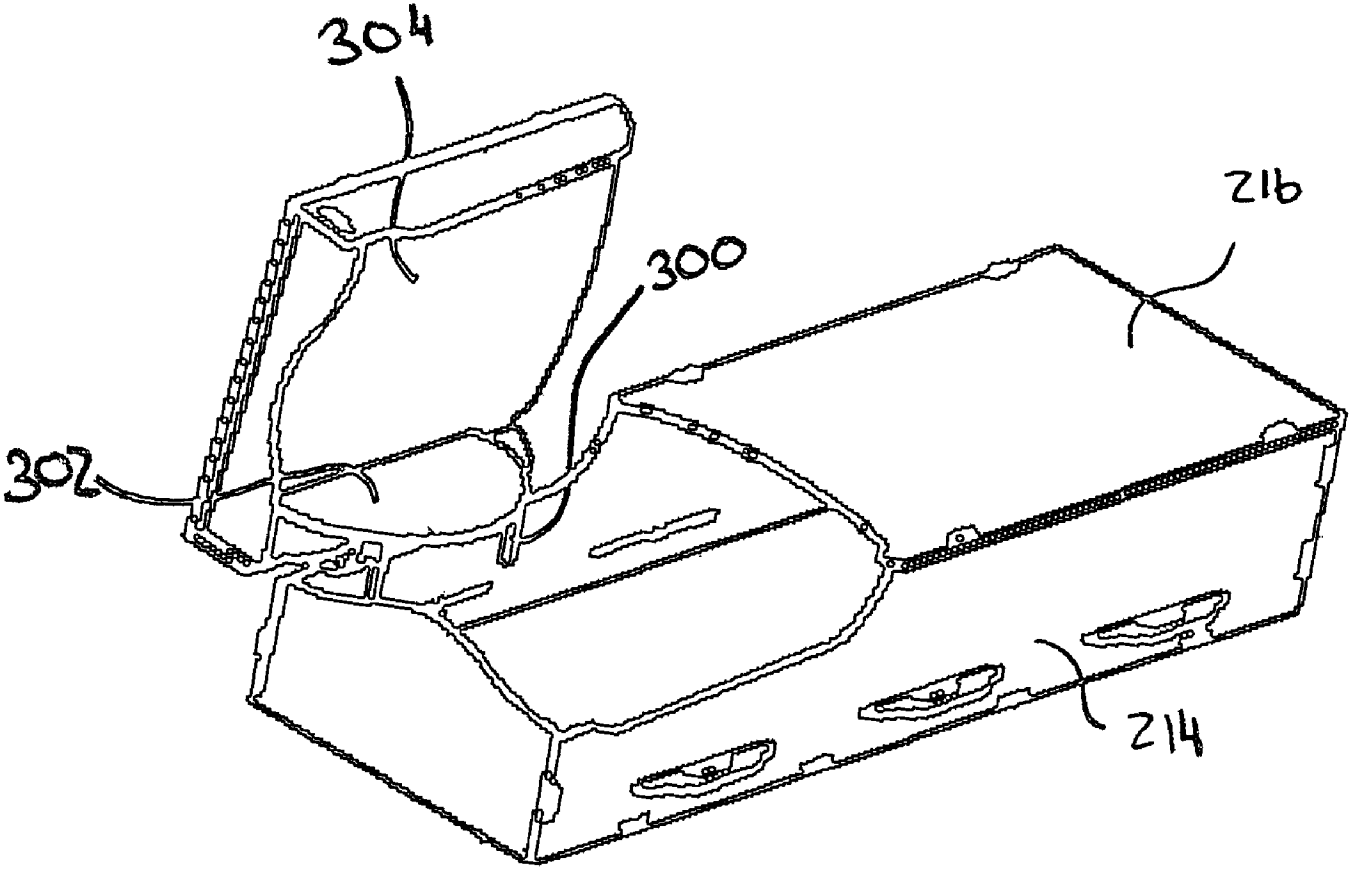
FIG. 27 shows a perspective view of the mortise and tenon casket of FIG. 26 with handles.

As shown in FIGS. 26 and 27, the bracket assembly 300 is designed to fit on the side panel 314 of a casket. The bracket assembly 300 holds the shelf 302, allowing the shelf to provide a substantially horizontal surface for supporting mementos of the deceased, such as flowers, pictures, an urn, a flag, or other item of sentimental value. At the same time, the bracket assembly 300 holds the removable lid 304 in an upright, substantially vertical position, such as approximately ninety degrees relative to the seated position of the lid on the casket. This upright position of the lid 304 provides the appearance of a traditional hinged casket with a non-removable lid, even though the lid 304 in the disclosed embodiment is not hinged or otherwise fastened to the side panel 314 of the casket. At the same time, the upright position of the lid 304 allows the underside of the lid to be used as a display surface. This display surface may be used to display pictures of the deceased and his or her loved ones and/or poetry or other words of significance.

Figure 29:
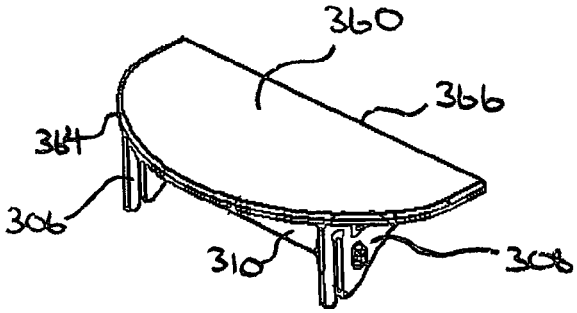
FIG. 29 shows a perspective view of the bracket assembly and shelf of FIG. 26.
Figure 30:
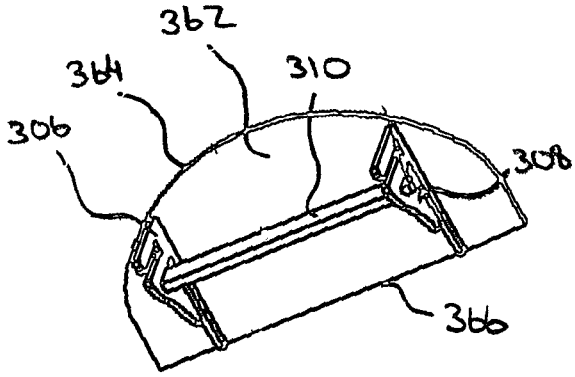
FIG. 30 shows another perspective view of the bracket assembly and shelf of FIG. 26.
Figure 31:
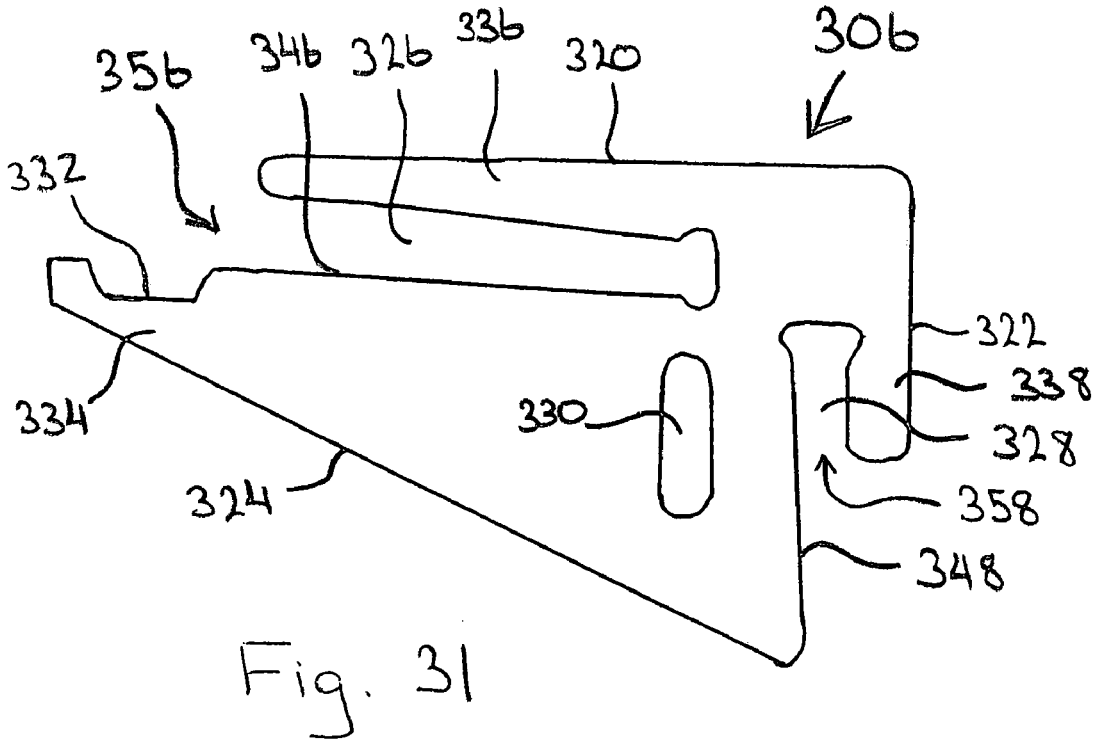
FIG. 31 shows a side elevational view of a bracket of the bracket assembly of FIG. 29.

FIGS. 28-32 show the bracket assembly 300 and shelf 302 in further detail. The bracket assembly 300 includes a first bracket 306 secured to a second bracket 308 by a support bar 310. FIG. 31 shows a side elevational view of the first bracket 306. The first bracket 306 is generally shaped as a right triangle and includes a top side 320, a depending side 322, and a hypotenuse side 324. A first channel 326 is formed in the bracket near the top side 320. The first channel 326 is defined by a top lip 336 and an opposing contact surface 346. A mouth 356 provides an entry into the first channel 326. The mouth 356 and first channel 326 are designed and dimensioned to snugly receive the lateral panel of the lid 304, such as lateral panel 218*b* described previously. A jaw 334 is provided near the mouth 356 of channel 326. The jaw 334 includes a notch 332 that is formed in the contact surface 346. The notch 332 is designed to engage the edge of the top panel of the casket lid 304, such as the edge of lid 218*a*. A second channel 328 is formed in the bracket near the depending side 322. The second channel 328 is defined by a side lip 338 and an opposing contact surface 348. A mouth 358 provides an entry into the second channel 328. The mouth 358 and first channel 328 are designed and dimensioned to snugly receive the side panel of the casket, such as side panel 214 described previously, allowing the bracket 306 to be hooked on to the edge of the side panel, thereby mounting the bracket 306 on the side panel of the casket. When mounted on the side panel of the casket, the side lip 338 is positioned within the casket, and the hypotenuse side 324 of the bracket is positioned outside of the casket. A mortise hole 330 is positioned upon the bracket 306 and is designed to receive a tenon on the support bar 310.

The second bracket 308 is substantially identical to the first bracket 306. Accordingly, the second bracket 308 is not explained in further detail herein.

Figure 32:
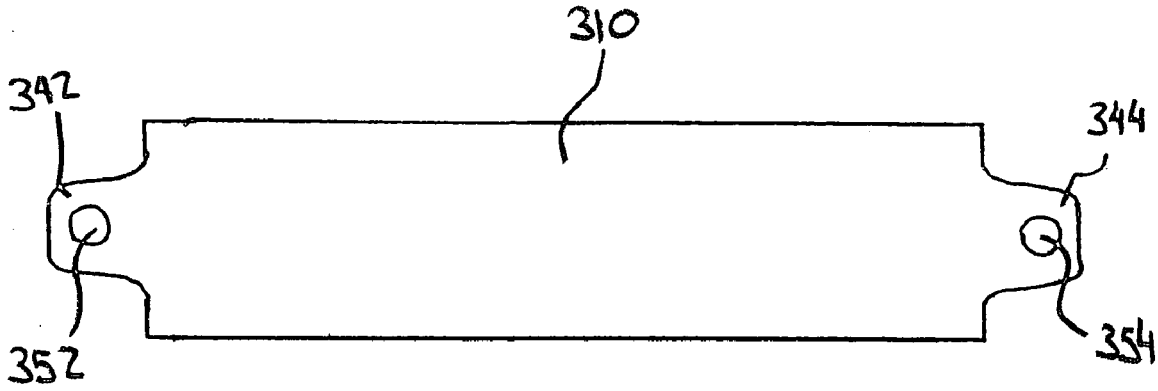
FIG. 32 shows a side elevational view of a support of the bracket assembly of FIG. 29.

The support bar 310 is shown in FIG. 32. The support bar is generally rectangular in shape and includes a first tenon 342 on one end and a second tenon 344 on an opposite end. Each tenon includes a pin hole 352 or 354. The tenons 342 and 344 are designed and dimensioned for insertion into the mortise hole 330 on one of the brackets 306 or 306. Once a tenon is inserted into a mortise hole, a pin is inserted into the pin hole in the tenon to secure the tenon in the mortise hole. Thus, the support bar 310 joins the first bracket 306 to the second bracket 308 in the bracket assembly 300.

Figure 28:
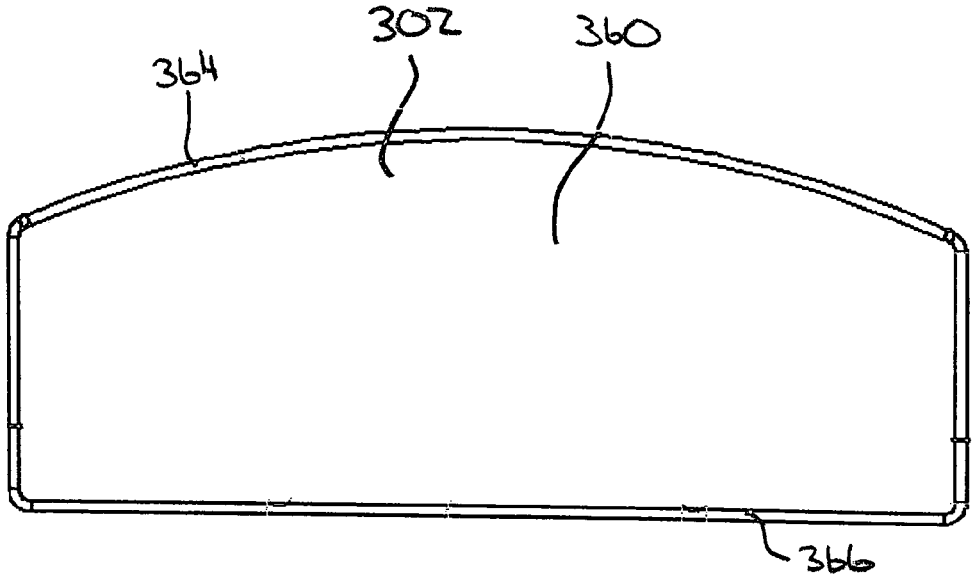
FIG. 28 shows a top view of a shelf used with the mortise and tenon casket of FIG. 26.

The shelf 302 is positioned upon the bracket assembly 300 such that the bottom of the shelf rests upon the top side 320 of the brackets 306 and 308, as shown in FIGS. 28-30. The shelf 302 includes a top surface 360, a bottom surface 362, a front curved edge 364, and a flat rear edge 366. The shelf may be permanently affixed to the bracket assembly 300 using fasteners or adhesives, or may simply rest on the top side 320 of the brackets when the bracket assembly when it is positioned on a casket. When the bracket assembly 300 is positioned on the casket, the rear flat edge 366 is positioned against the bottom side of the casket lid, allowing the more attractive front curved edge 364 to be presented for viewing.

With reference again to FIG. 26, an alternative handle arrangement is shown. In particular, the pallbearer handles for the casket are formed by a decorative bar 370 having tabs that fit into the enlarged holes 237 in the side panel 214. Sufficient space is provided between the side panel 214 and the decorative bar to allow the fingers of the pallbearer to grab the bar. Also, the bar has a shortened profile 272 at several locations to accommodate the hand of a pallbearer gripping the bar.

With continued reference to FIG. 26, a modesty skirt 270 may be provided in the casket to separate the inferior end portion of the casket from the superior end portion. The modesty skirt is a cloth that hangs from the second lid 216 of the casket 210. The modesty skirt allows the casket to accommodate various body sizes while providing a barrier between the inferior end portion and the superior end portion of the casket.

Figure 34:
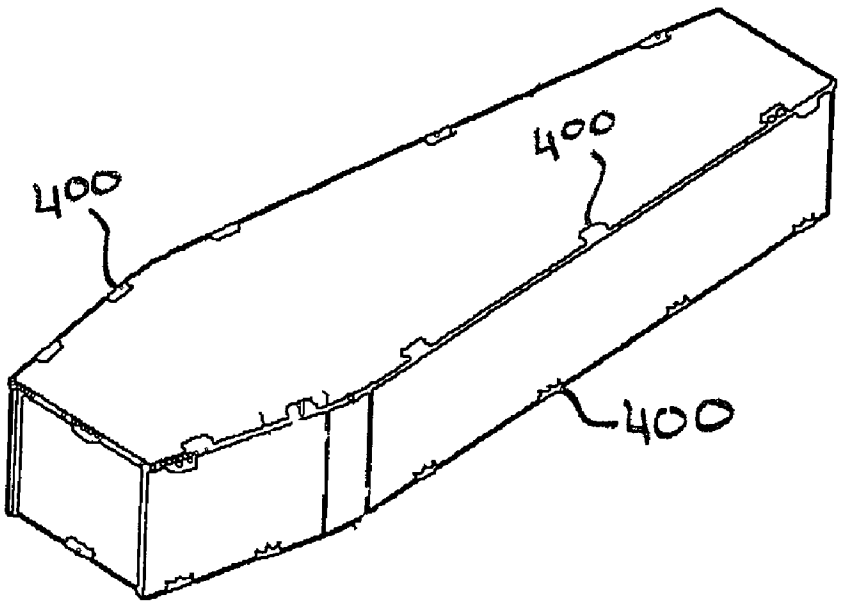
FIG. 34 shows the mortise and tenon casket of FIG. 33 including a lid.
Figure 33:
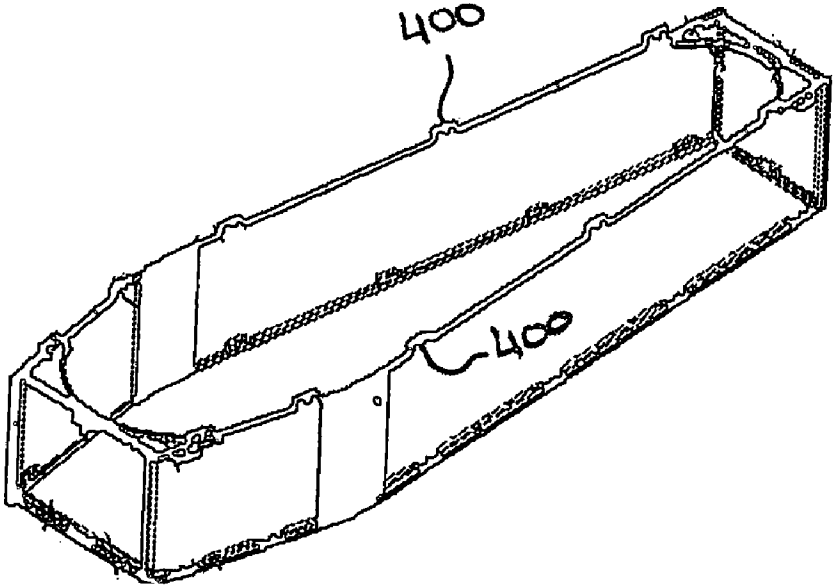
FIG. 33 shows an alternative embodiment of a mortise and tenon casket without a lid.

Although the term "casket" has been used herein in reference to the disclosed drawings, it will be readily understood by one of ordinary skill in the art that the invention is applicable to any coffin, box, chest or other container for burying a corpse. For example, a casket incorporating features of the present invention may take the form shown in FIGS. 33 and 34. As shown in FIGS. 33 and 34, a plurality of mortise and tenon fasteners 400 are provided on the casket with a polygonal footprint. The mortise and tenon fasteners 400 provide a unique and pleasing appearance for the casket. At the same time, the casket may be designed to include other features and advantages of the invention as discussed above. For example, the caskets shown in FIGS. 33 and 34 may include a two-part lid and a low-profile side panel for viewing the deceased. Of course, numerous other shapes and sizes of containers than those disclosed in the figures herein may be used without departing from the spirit and scope of the invention.

Additionally, although the present invention has been described with respect to certain preferred embodiments, it will be appreciated by those of skill in the art that other implementations and adaptations are possible. Moreover, there are advantages to individual advancements described herein that may be obtained without incorporating other aspects described above. Therefore, the spirit and scope of the appended claims should not be limited to the description of the embodiments contained herein.

What is claimed is:

1. A casket comprising:

a container having a bottom and four sides integrally formed;

a first lid having a top and a plurality of sides integrally formed of corrugated paper, the first lid covering a first portion of the container, at least a first side of the first lid disposed intermediate two ends of the container;

a second lid having a top and a plurality of sides integrally formed of corrugated paper, the second lid covering a second portion of the container, at least a second side of the second lid disposed intermediate the two ends of the container; and wherein each of the first side and the second side includes a concavity.

2. The casket of claim 1 wherein the concavity of the first side is rounded.

3. The casket of claim 1 wherein the concavity of the first side is polygonal.

4. The casket of claim 1 wherein the first portion of the container has a first height and the second portion of the container has a second height, the first height smaller than the second height.

5. The casket of claim 1 wherein the first lid comprises a single piece of corrugated having a plurality of fold lines, and wherein the plurality of sides are formed by folding the sides approximately perpendicularly from the top.

6. The casket of claim 1 wherein the first lid further comprises a substantially planar top and each of the plurality of sides is substantially planar.

7. The casket of claim 1 wherein at least one side of the container includes a notch intermediate its two ends, the notch adapted to receive and retain a portion of the first side.

8. A casket comprising:

a. a container including a bottom, two elongated sides, a superior end portion and an inferior end portion, at least one of the elongated sides including a recessed portion at the superior end portion of the container and a non-recessed portion at the inferior end portion of the container, wherein the height of the at least one of the elongated sides is less at the recessed portion than at the non-recessed portion;

b. a first lid for covering the superior end portion of the container; and c. a second lid for covering the inferior end portion of the container;

wherein the container is integrally formed from a single piece of corrugated paper.

9. The casket of claim 8 further comprising a plurality of handles provided on the two elongated sides.

10. The casket of claim 9 wherein each of the plurality of handles are secured within one of a plurality of openings formed in the two elongated sides.

11. The casket of claim 10 wherein each opening includes a top edge and a bottom edge, and each of the plurality of handles includes an upper seating structure designed to engage the top edge of the opening.

12. The casket of claim 11 wherein each the upper seating structure includes an outer upward extension, an inner upward extension and a handle body extending between the top edge and the bottom edge of the opening.

13. The casket of claim 10 wherein each of the plurality of handles includes a tab designed and dimensioned for insertion into one of the plurality of openings formed in the two elongated sides.

14. The casket of claim 13 wherein each of the plurality of handles includes a pinhole and a pin is inserted through the pinhole to secure the handle in the opening.

15. A casket comprising:

a. a container including a bottom, two elongated sides, a superior end portion and an inferior end portion, at least one of the elongated sides including a recessed portion at the superior end portion of the container and a non-recessed portion at the inferior end portion of the container, wherein the height of the at least one of the elongated sides is less at the recessed portion than at the non-recessed portion;

b. a first lid for covering the superior end portion of the container;

c. a second lid for covering the inferior end portion of the container;

d. a plurality of handles provided on the two elongated sides, each of the plurality of handles secured within one of a plurality of openings formed in the two elongated sides, each opening including a top edge and a bottom edge, each of the plurality of handles includes an upper seating structure designed to engage the top edge of the opening, and each upper seating structure including an outer upward extension, an inner upward extension and a handle body extending between the top edge and the bottom edge of the opening.

16. The casket of claim 15 wherein the container is formed by a plurality of separate panels defining the bottom, the two elongated sides, the superior end portion, and the inferior end portion.

17. The casket of claim 16 wherein the panels are wood.

* * * * *